US006539679B1

(12) United States Patent
Brasington

(10) Patent No.: US 6,539,679 B1
(45) Date of Patent: Apr. 1, 2003

(54) STRUCTURAL MEMBER WITH STRENGTH-REINFORCING STEEL STRAP

(76) Inventor: Millard A. Brasington, 182 Freeze Crossing Dr., Mooresville, NC (US) 28115

( * ) Notice: Subject to any disclaimer, the term of this patent is extended or adjusted under 35 U.S.C. 154(b) by 0 days.

(21) Appl. No.: 09/610,796

(22) Filed: Jul. 6, 2000

Related U.S. Application Data

(63) Continuation-in-part of application No. 09/173,877, filed on Oct. 16, 1998, now Pat. No. 6,112,484.

(51) Int. Cl.[7] ..... E04C 3/10
(52) U.S. Cl. ..... 52/223.6; 52/223.12
(58) Field of Search ..... 52/223.6, 223.8, 52/223.12, 650.3, 654.1, 647, 291; 29/897.32, 897.35, 897.31, 897.3, 897.312

(56) References Cited

U.S. PATENT DOCUMENTS

| | | | | | |
|---|---|---|---|---|---|
| 275,832 | A | * | 4/1883 | Lockwood | 52/291 |
| 1,770,932 | A | | 7/1930 | Leake | |
| 2,039,398 | A | | 5/1936 | Dye | |
| 2,175,688 | A | * | 10/1939 | Ferris | 52/291 |
| 2,510,958 | A | | 6/1950 | Coff | |
| 2,578,240 | A | * | 12/1951 | Green et al. | 52/291 |
| 2,822,068 | A | | 2/1958 | Hendrix | |
| 3,294,608 | A | | 12/1966 | Peterson | |
| 3,398,498 | A | | 8/1968 | Krauss | |
| 3,427,773 | A | | 2/1969 | Kandall | |
| 4,006,523 | A | | 2/1977 | Mauquoy | |
| 4,015,376 | A | | 4/1977 | Gerhardt | |
| 4,236,362 | A | | 12/1980 | Omholt | |
| 4,267,667 | A | * | 5/1981 | Ingham | 52/291 |
| 4,275,537 | A | | 6/1981 | Pinson | |
| 4,353,190 | A | | 10/1982 | Gleeson | |
| 4,409,764 | A | | 10/1983 | Wilnau | |
| 4,561,227 | A | | 12/1985 | Austin | |
| 4,607,470 | A | | 8/1986 | Ecker | |
| 4,704,830 | A | | 11/1987 | Magadini | |
| 5,048,257 | A | | 9/1991 | Luedtke | |
| 5,134,821 | A | | 8/1992 | Sadahiro | |
| 5,467,570 | A | | 11/1995 | Leek | |
| 5,937,608 | A | * | 8/1999 | Kucirka | 52/291 |

* cited by examiner

*Primary Examiner*—Michael Safavi
(74) *Attorney, Agent, or Firm*—Adams, Schwartz & Evans, P.A.

(57) ABSTRACT

A load-bearing structural member includes an elongate structure body and a strength-reinforcing flat steel strap. The structure body has a top and a bottom, and first and second opposing ends. The steel strap extends along the length of the structure body from one end to the other, and is adapted for transferring an intermediate load acting on the structure body outwardly to the opposing ends of the structure body. Anchor plates located at respective opposing ends of the structure body engage and hold the strap in tension.

14 Claims, 26 Drawing Sheets

STRUCTURAL MEMBER WITH STRENGTH-REINFORCING STEEL STRAP

This application is a continuation-in-part of U.S. Ser. No. 09/173,877, filed on Oct. 16, 1998, and entitled "STRUCTURAL MEMBER WITH STRENGTH-REINFORCING STEEL STRAP " now U.S. Pat. No. 6,112,484.

TECHNICAL FIELD AND BACKGROUND OF THE INVENTION

The invention relates to a load-bearing structural member. The structural member includes one or more strength-reinforcing, tensioned steel straps adapted for transferring an intermediate lateral load acting on the member to its supported ends. The invention is applicable to standard light-gauge steel C-channels, U-channels, Z-purlins, I-beams, and girts, square tubing, and light-gauge prefabricated building sections, such as floor trusses, stud or curtain walls, and roof panels. The invention provides a lightweight structural member with an extended span reach, and which is less costly and more functional than existing structures of equivalent strength and span.

A principle object of the invention is to create a maximum supporting reaction force at a predetermined location between the ends of the structural member in a manner that will not significantly increase the weight and/or cost of the member. The invention will double the span of the structural member without reducing its load-bearing capacity. For example, a standard 24 foot beam has a maximum supporting reaction force at its supported ends and a minimum supporting reaction force at its center point 12 feet from either end. Longer beams have less strength at the center point, and must therefore be made of a heavier gauge steel or must include separately attached reinforcing structure which can substantially increase the overall weight and cost of the beam. The present invention adds cost, lightweight reaction support at the center point of the beam, thereby shifting the area of less strength to respective mid-points between the center and ends of the beam.

Attempts have been made in the past to strengthen conventional beams using one or more steel cable tendons attached to opposite ends of the beam in tension, and forced downwardly and attached at intermediate points of the beam. Cable tendons, however, are costly and generally too elastic to maintain proper tension over time. For example, for every 1/50th of an inch of relaxing tension on a steel cable under 2500 lbs. of tension, residual tension in the cable is reduced by 100 lbs. To control elongation, the cables are typically pretensioned and imbedded in relatively heavy cement-type material and held rigid the full length of the beam. This is not an option with light-gauge structural members.

SUMMARY OF THE INVENTION

Therefore, it is an object of the invention to provide a lightweight structural member which can span twice the distance of a conventional member without reducing its load-bearing capacity.

It is another object of the invention to provide a structural member which has twice the load-bearing capacity of a conventional member of substantially equal length.

It is another object of the invention to provide a structural member which is relatively inexpensive to manufacture.

It is another object of the invention to provide a structural member which uses a strength-reinforcing, flat steel strap which resists stretching under lineal tension.

It is another object of the invention to provide a structural member including a tensioned flat steel strap which will maintain a predetermined degree of tension over time.

It is another object of the invention to provide a structural member including a tensioned flat steel strap with a tensile strength of between 100,000 and 140,000 psi.

It is another object of the invention to provide a structural member including a tensioned flat steel strap which is stress-proof.

It is another object of the invention to provide a structural member including a tensioned flat steel strap which is tension-tested.

It is another object of the invention to provide a structural member including a tensioned flat steel strap which is anchored at opposing ends of the member without penetrating the strap from one major surface to the other.

It is another object of the invention to provide a structural member which uses two or more strength-reinforcing flat steel straps.

It is another object of the invention to provide a structural member which can be quickly and easily assembled.

It is another object of the invention to provide a structural member which is clearly marked to indicate the horizontal and vertical tension pulled on the steel strap.

It is another object of the invention to provide a method of forming a load-bearing structural member.

These and other objects of the present invention are achieved in the preferred embodiments disclosed below by providing a load-bearing structural member including an elongate beam and a strength-reinforcing flat steel strap. The beam has a top and a bottom, and first and second opposing ends. The steel strap extends along the length of the beam from one end to the other, and is adapted for transferring an intermediate load acting on the beam outwardly to the opposing ends of the beam. Anchoring means located at respective opposing ends of the beam engage and hold the strap in tension.

According to one preferred embodiment of the invention, the strap is anchored to the opposing ends of the beam at the top of the beam. A vertical tensioning post located between the ends of the beam engages and holds the strap adjacent the bottom of the beam. The tensioning post and strap cooperate to create an increased supporting reaction force between the ends of the beam at the location of the post.

According to another preferred embodiment of the invention, the vertical tensioning post is centrally located between the ends of the beam.

According to yet another preferred embodiment of the invention, the strap is formed of light-gauge, stress-proof steel having a tensile strength of at least 100,000 psi.

According to yet another preferred embodiment of the invention, the beam is formed of light-gauge steel.

According to yet another preferred embodiment of the invention, the beam has a generally V-shaped or U-shaped cross-section with a bottom, opposing sides integrally formed with the bottom, and respective flanges integrally formed with the sides.

According to yet another preferred embodiment of the invention, each of the flanges includes a longitudinal fastener groove for receiving fasteners.

According to yet another preferred embodiment of the invention, at least one lateral spreader bar is located between the sides of the beam to maintain uniform spacing of the sides from one end of the beam to the other.

According to yet another preferred embodiment of the invention, the anchoring means includes cooperating top and bottom anchor plates attached to each end of the beam. The anchor plates engage opposing major surfaces of the flat steel strap to frictionally hold the strap in tension without penetrating the strap from one major surface to the other.

According to yet another preferred embodiment of the invention, the anchor plates include a series of mating, spaced-apart, lateral crimps.

According to yet another preferred embodiment of the invention, the depth of the crimps formed in the anchor plates increases from an inside edge of the plates to an outside edge of the plates.

According to yet another preferred embodiment of the invention, the width of the crimps formed in the anchor plates is no greater than 80% of the width of the strap.

According to yet another preferred embodiment of the invention, the anchor plates are attached to the beam by a plurality of fasteners extending through the beam and plates, and adjacent to opposing side edges of strap.

According to yet another preferred embodiment of the invention, the anchor plates extend at an angle from the top of the beam towards the bottom of the beam to define a sloping bed for holding the strap.

According to yet another preferred embodiment of the invention, the beam is a steel C-channel including a vertical web member and spaced-apart top and bottom flange members integrally formed with the web member.

According to yet another preferred embodiment of the invention, top and bottom support panels are attached to respective top and bottom flange members of the C-channel.

According to yet another preferred embodiment of the invention, the flange members include respective integrally-formed hooks adapted for mating with complementary hooks formed with respective top and bottom panels for connecting the panels and the beam together.

In another embodiment, the invention includes a method of forming a load-bearing structural member including the steps of anchoring one end of a strength-reinforcing flat steel strap to one end of a beam, and pulling an opposing end of the strap towards an opposing end of the beam to tension the strap. The opposing end of the strap is then anchored to the opposing end of the beam. The strap is held in tension between the ends of the beam and is adapted for transferring an intermediate load acting on the beam outwardly towards the ends of the beam.

According to another preferred embodiment of the invention, the method includes anchoring the strap to the opposing ends of the beam at a top of the beam, and then applying a downward vertical force to the strap at a point intermediate of the opposing ends. The strap is then held to the beam at the intermediate point adjacent a bottom of the beam without welding or attaching to the top of the beam, thereby creating an increased supporting reaction force between the ends of the beam at the intermediate point.

According to yet another preferred embodiment of the invention, the method includes marking the tension force applied to the strap on a surface of the beam.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
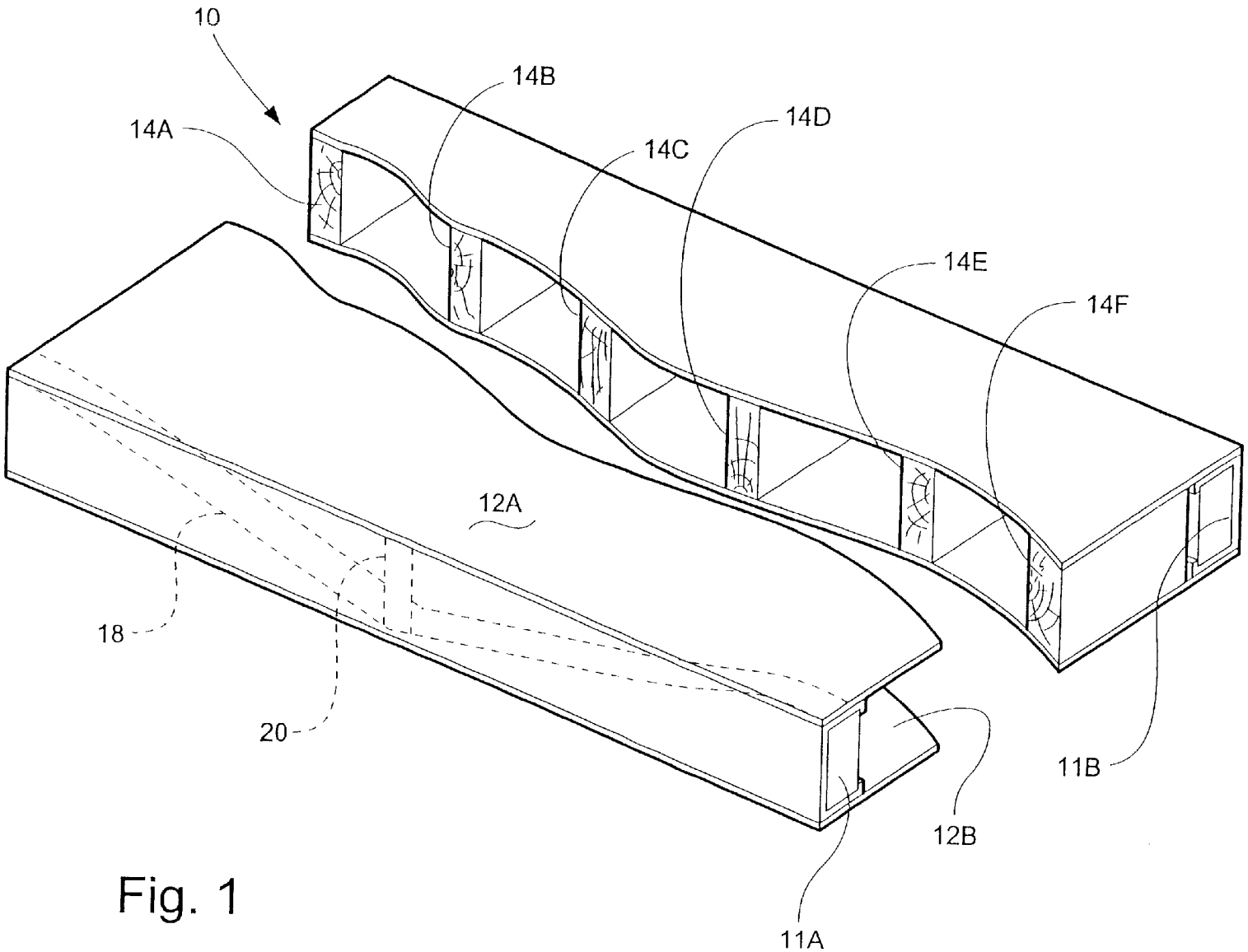
FIG. 1 is a fragmentary, perspective view of a structural member according to one preferred embodiment of the present invention, and showing the tensioned strap in phantom.
Figure 6:
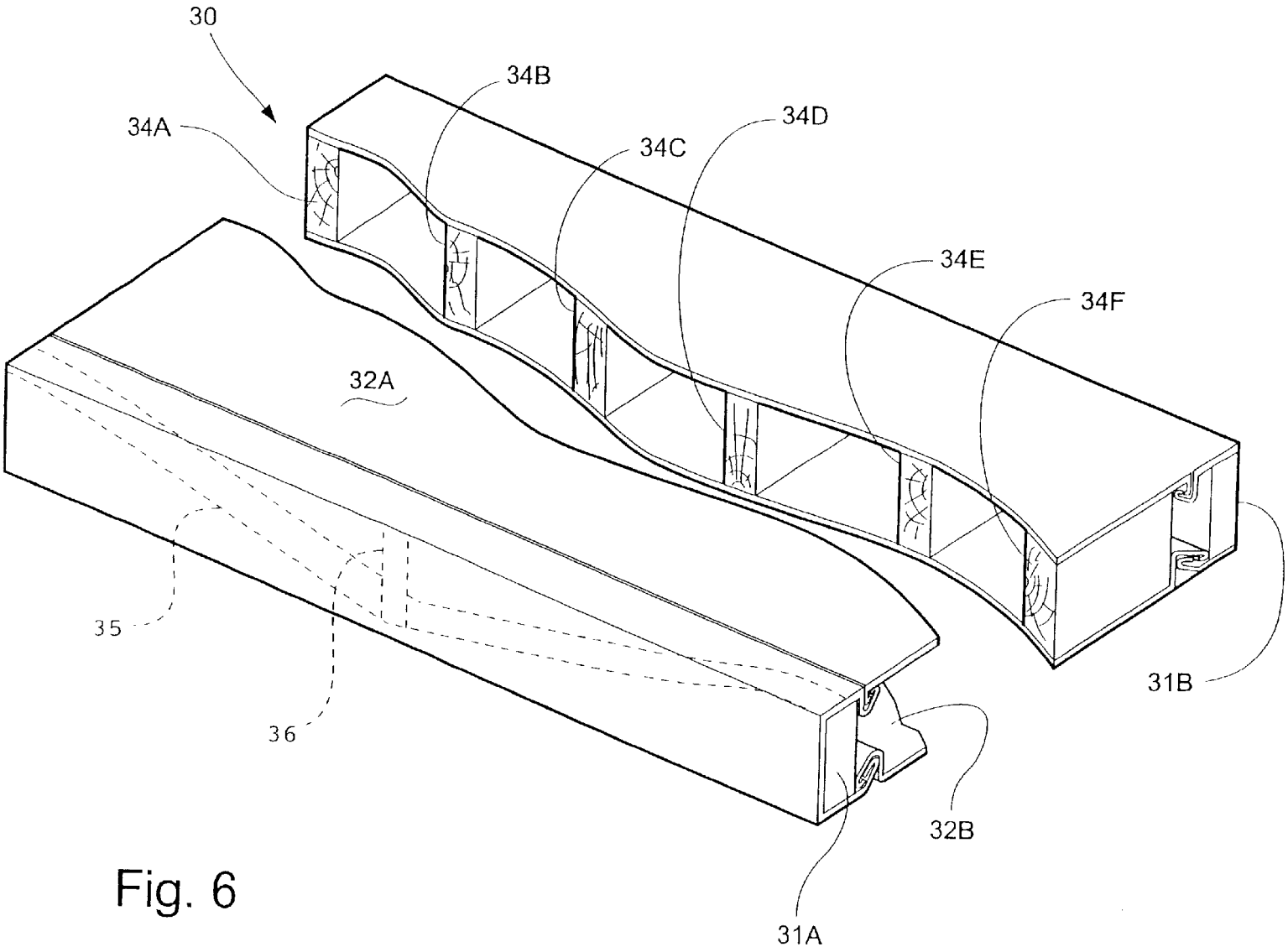
FIG. 6 is a fragmentary, perspective view of a structural member according to a second preferred embodiment of the invention with the tensioned strap.
Figure 8:
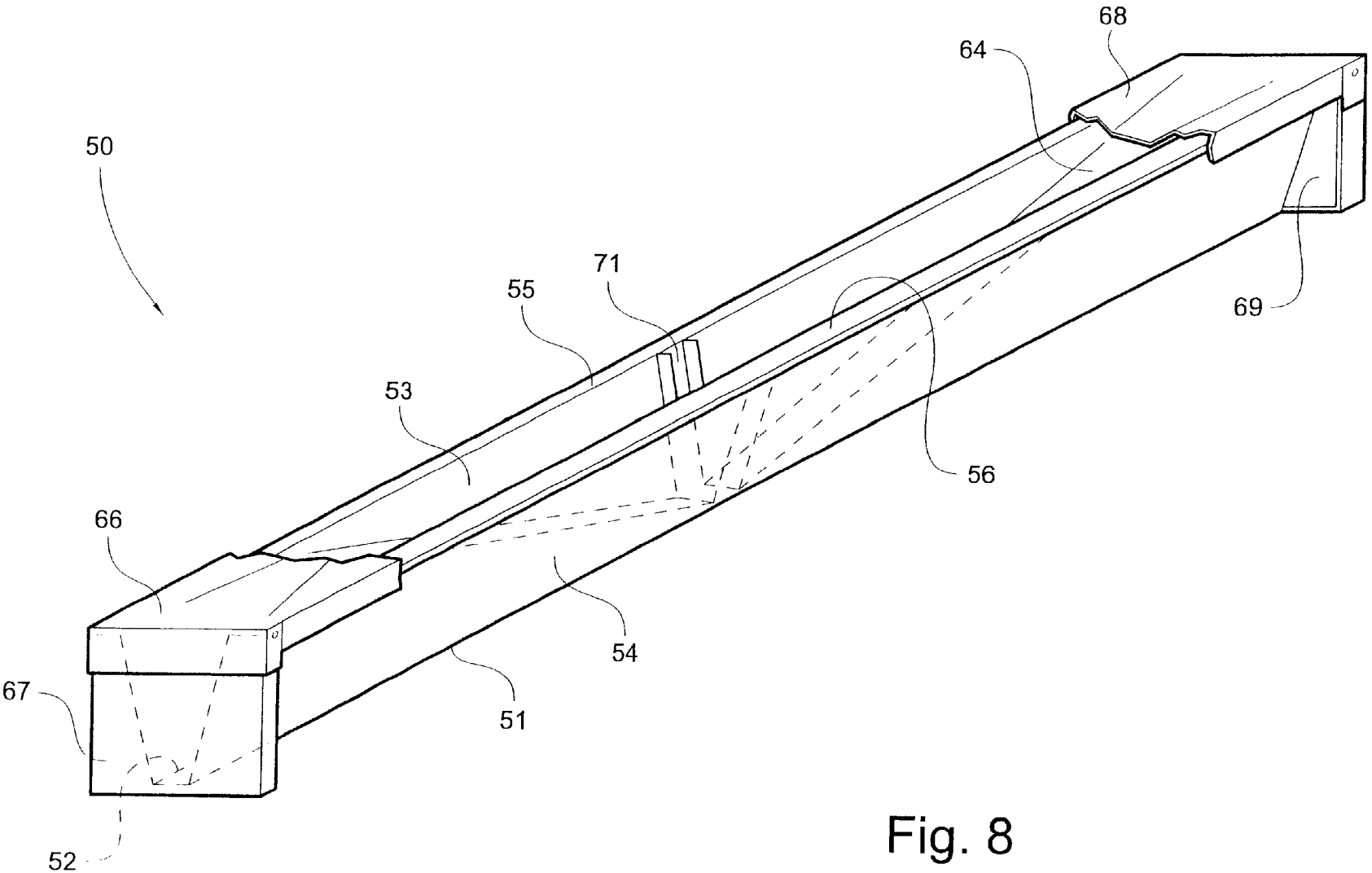
FIG. 8 is a perspective view of a structural member according to a third preferred embodiment of the invention with the tensioned strap shown in phantom.

Referring now specifically to the drawings, a load-bearing structural member according to the present invention is illustrated in FIG. 1 and shown generally at reference numeral 10. The structural member 10 may comprise, for example, a light-weight prefabricated floor or roof truss, such as shown in FIGS. 1 and 6, a stud or curtain wall, or a single strength-reinforced beam assembly, such as shown in FIG. 8.

Figure 2:
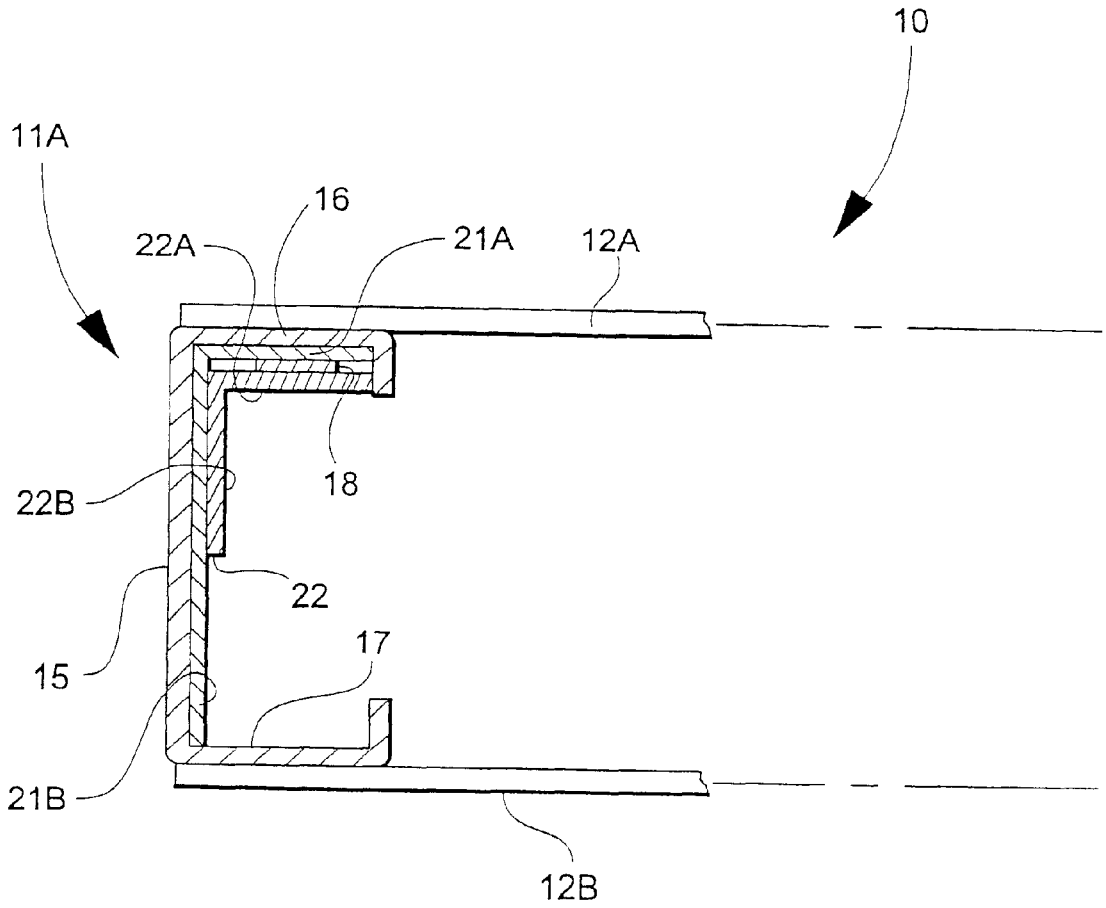
FIG. 2 shows a fragmentary, lateral cross-section of the structural member.
Figure 3:
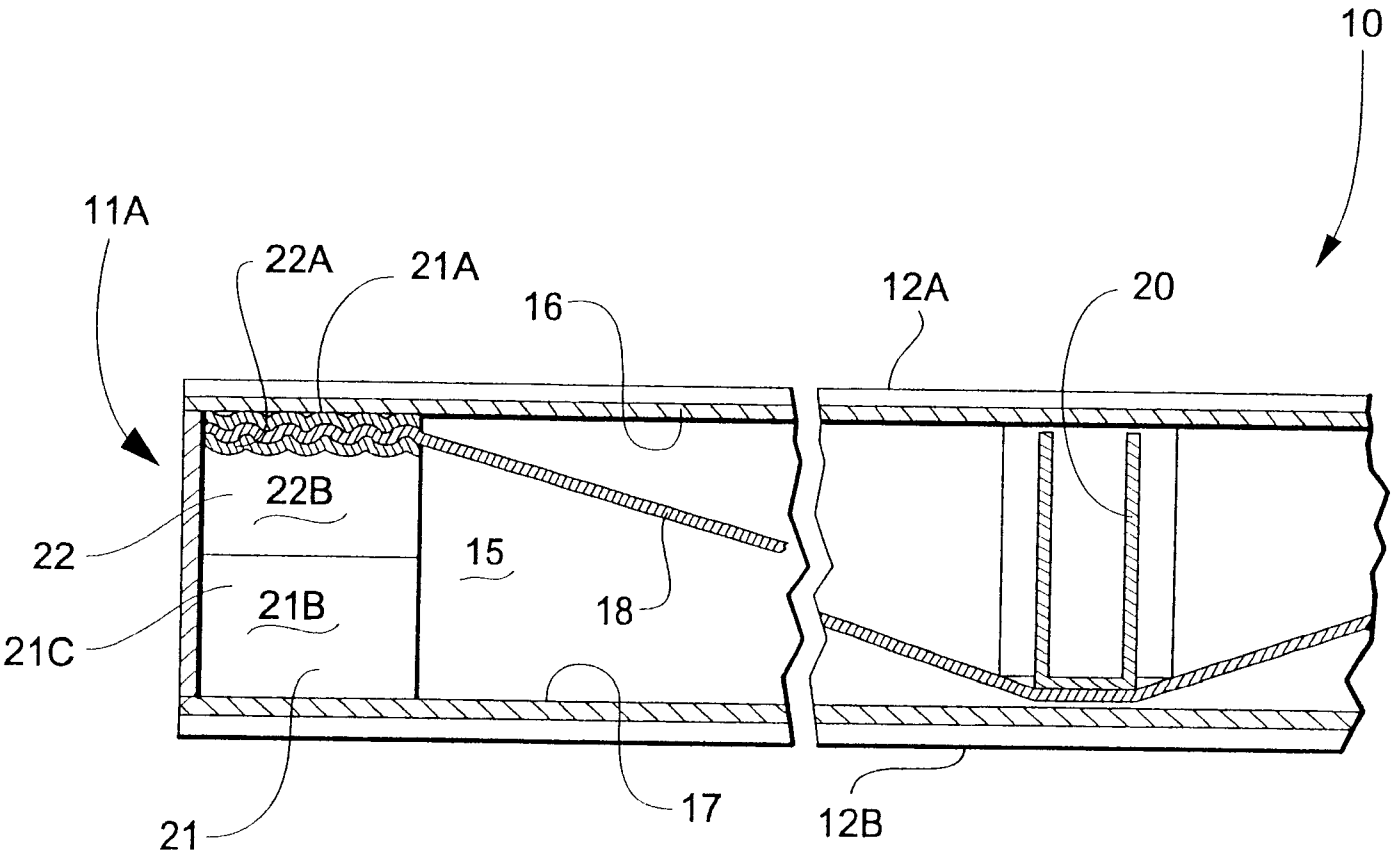
FIG. 3 shows a fragmentary, longitudinal cross-section of the structural member.

Referring to FIGS. 1–3, the structural member 10 is constructed of identical, spaced-apart, light-gauge steel beams 11A and 11B, top and bottom panels 12A and 12B attached to the beams 11A and 11B, and a number of spaced-apart lateral cross braces 14A–14F. The gauge of steel used for each beam 11A, 11B is preferably between 16 and 18. The term "beam" as used herein is broadly defined as any structure with one dimension large as compared to the other dimensions, and whose function is to carry loads perpendicular to the large dimension.

The top and bottom panels 12A and 12B are formed of plywood, sheet rock, or light-gauge steel in the range of 18 to 20. The panels 12A, 12B are attached to the beams 11A, 11B using metal screws, rivets or other suitable fasteners (not shown). The cross braces 14A–14F are preferably formed of wood or light-gauge steel channel or tubing, and are attached to the panels 12A, 12B using metal screws, rivets or other fasteners (not shown). A single strength-reinforced beam 11A is described below.

As best shown in FIGS. 2 and 3, the beam 11A is an 8in.×1.5 in.×24 ft.×18 ga. steel C-channel with a vertical web member 15 and opposing, integrally-formed top and bottom flange members 16 and 17. A flat, pretensioned, stress-proof steel strap 18 is secured in tension to opposing ends of the beam 11A at an underside of the top flange member 16, and is pulled downwardly towards the bottom flange 17 at a center point of the beam 11A and held by a vertical tensioning posting 20 attached to the web member 15. Unlike steel cables, the tensioned strap 18 resists stretching and reduction in lineal tension over time, and has superior strength to weight to size ratio. In the embodiment shown, the tensioned strap 18 used is 1.5in.×5000 lbs.× .031 in., and is tension tested to 130,000 psi. A minimum tensile strength of 100,000 psi is preferred. In other applications of the invention, the tension strap may be several inches thick with a much greater tensile strength.

The ends of the tensioned strap 18 are anchored adjacent the underside of the top flange member 16 of the beam 11A using respective pairs of inside and outside anchor plates 21 and 22. The inside anchor plate 21 includes a top wall 21A residing adjacent the top flange member 16, a side wall 21B residing adjacent the web member 15, and an end wall 21C covering the end of the beam 11A. The outside anchor plate 22 includes a top wall 22A, and a side wall 22B residing adjacent the side wall 21B of the inside anchor plate 21. The anchor plates 21, 22 are attached together and to the beam 11A using suitable fasteners (not shown), and cooperate to sandwich the end of the tensioned strap 18 between their respective top walls 21A and 22A to frictionally hold the strap 18 to the beam 11A.

Figure 4:
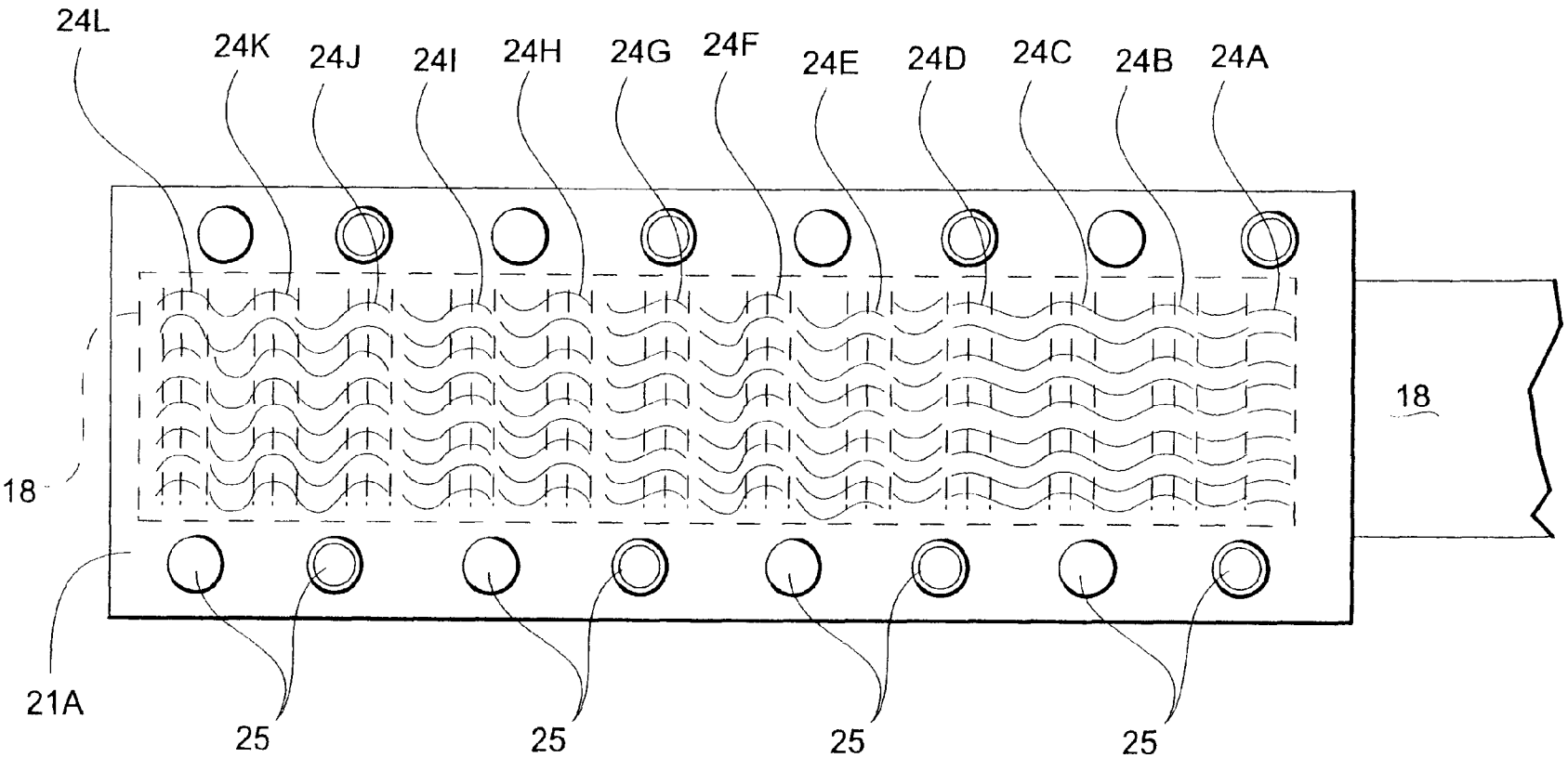
FIG. 4 is a top plan view of the inside anchor plate with an end portion of the tensioned strap shown in phantom.
Figure 5:
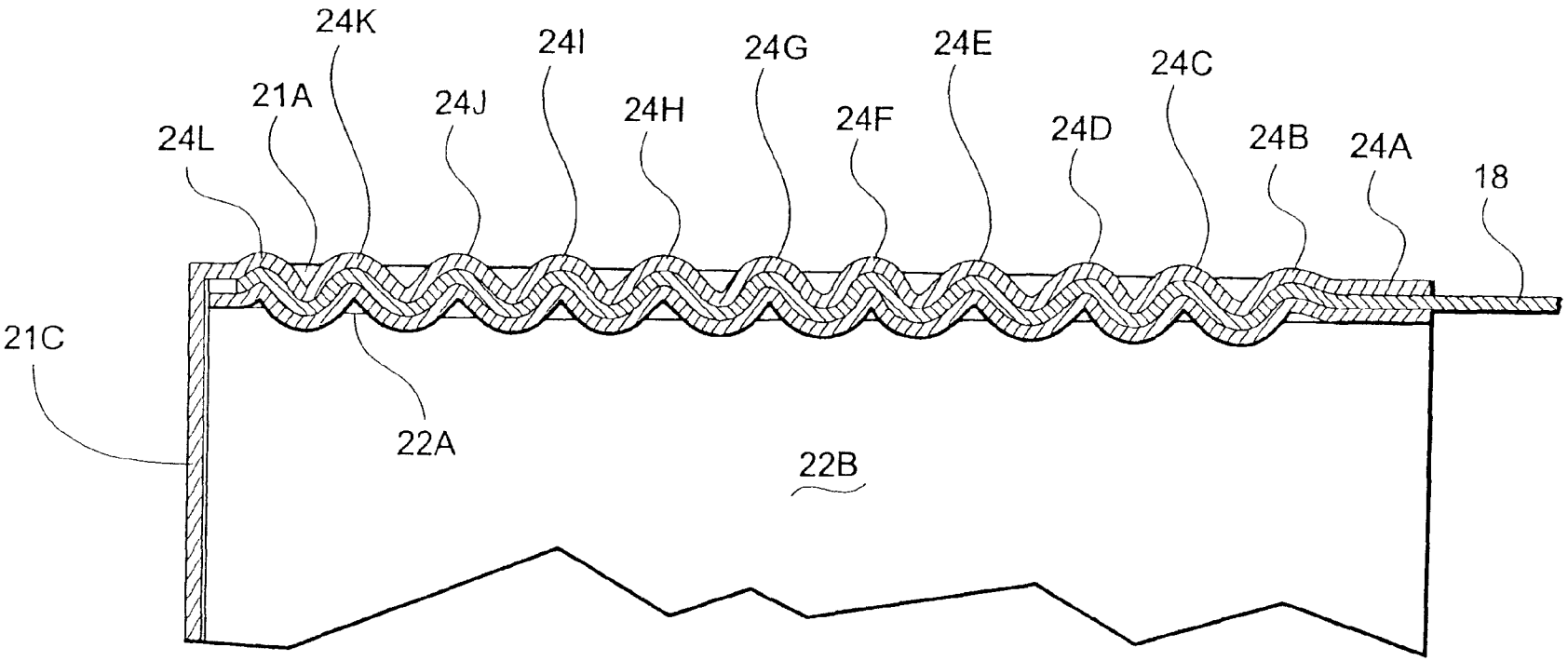
FIG. 5 shows a fragmentary, longitudinal cross-section of the inside and outside anchor plates with the tensioned strap held between the mating crimps.

The top walls 21A, 22A include a series of mating crimps 24A–24L, shown in FIGS. 4 and 5, which engage the tensioned strap 18 to further increase the friction holding strength of the anchor plates 21 and 22. The crimps 24A–24L are preferably stamped into the top walls 21A, 22A and tensioned strap 18 simultaneously prior to attaching the anchor plates 21, 22 to the beam 11A. When forming the crimps 24A–24L, care must be taken to avoid crimping, penetrating or distorting either longitudinal side edge of the tensioned strap 18. The side margins of the tensioned strap 18 should stay flat and straight to prevent the formation of weak spots where fatigue or breakage could occur. As best shown in FIG. 4, the crimps 24A–24L preferably reach only 80% of the width of the strap 18 with the ends of each crimp tapering to a flat surface. A number of fastener holes 25 are formed through the anchor plates 21, 22 on opposite sides of the crimped area for receiving respective fasteners through the top flange member 16 and anchor plates 21, 22 without engaging the strap 18.

According to the preferred embodiment shown, a series of 12 mating crimps 24A–24L cooperate to hold the tensioned strap 18 between the top walls 21A and 22A of the anchor plates 21 and 22. The crimp pattern is strategic. The first crimp 24A starts ⅜ in. from the inside edge of the anchor plate 21, and has an arc radius of 0.25 times the thickness of the tensioned strap 18. The second crimp 24B has an arc radius of 0.5 times the thickness of the strap 18. The third crimp 24C has an arc radius of 0.75 times the thickness of the strap 18. The fourth crimp 24D has an arc radius equal to the thickness of the strap 18. The fifth crimp 24E has an arc radius of 1.25 times the thickness of the strap 18. The sixth and succeeding crimps 24F–24L have respective arc radiuses of 1.5 times the thickness of the strap 18. The optimal distance between each crimp 24A–24L is determined by the thickness of the anchor plates 21, 22 and strap 18, and the tangent of the crimp arc.

Gradual crimping of the tensioned strap 18, as described above, spreads the tension stress over a greater length of the strap 18 to reduce moment fatigue and the likelihood of strap failure. In the embodiment described, five crimps 24 with a crimp radius equal to 1.5 times the thickness of the strap 18 will generally hold a tension force equal to the tensile strength of the strap 18. To achieve maximum holding strength, it is important that there not be penetration or rupture of the strap 18 during crimping, or in an area of the strap in tension.

The vertical tensioning post 20 is applied to the beam 11A after the desired lineal tension is pulled on the strap 18 and the ends of the strap 18 anchored to the beam 11A, as described above. The strap 18 is pulled vertically downwardly at a center point of the beam 11A, and the tensioning post 20 mounted to the web member 15 to hold the strap 18 in position adjacent the bottom flange member 17. As shown in FIG. 3, minimal clearance is provided between the strap-engaging end of the post 20 and the bottom flange member 17 of the beam 11A. The end of the post 20 is sufficiently wide to engage the entire width of the strap 18. Because of substantial tension in the strap 18, the supporting reaction force on the beam 11A is greatest at the location of the tensioning post 20. Thus, with its ends supported vertically, the beam 11A is capable of carrying a maximum lateral load at its center point. The tensioned strap 18 effectively transfers this load to the supported ends of the beam 11A. The beam 11A is weakest at respective mid-points between the location of the post 20 and the ends of the beam 11A. The top and bottom panels 12A and 12B and cross members 14A–14F help resist the tendency of the beam 11A to buckle inwardly under the tension of the strap 18.

Figure 7:
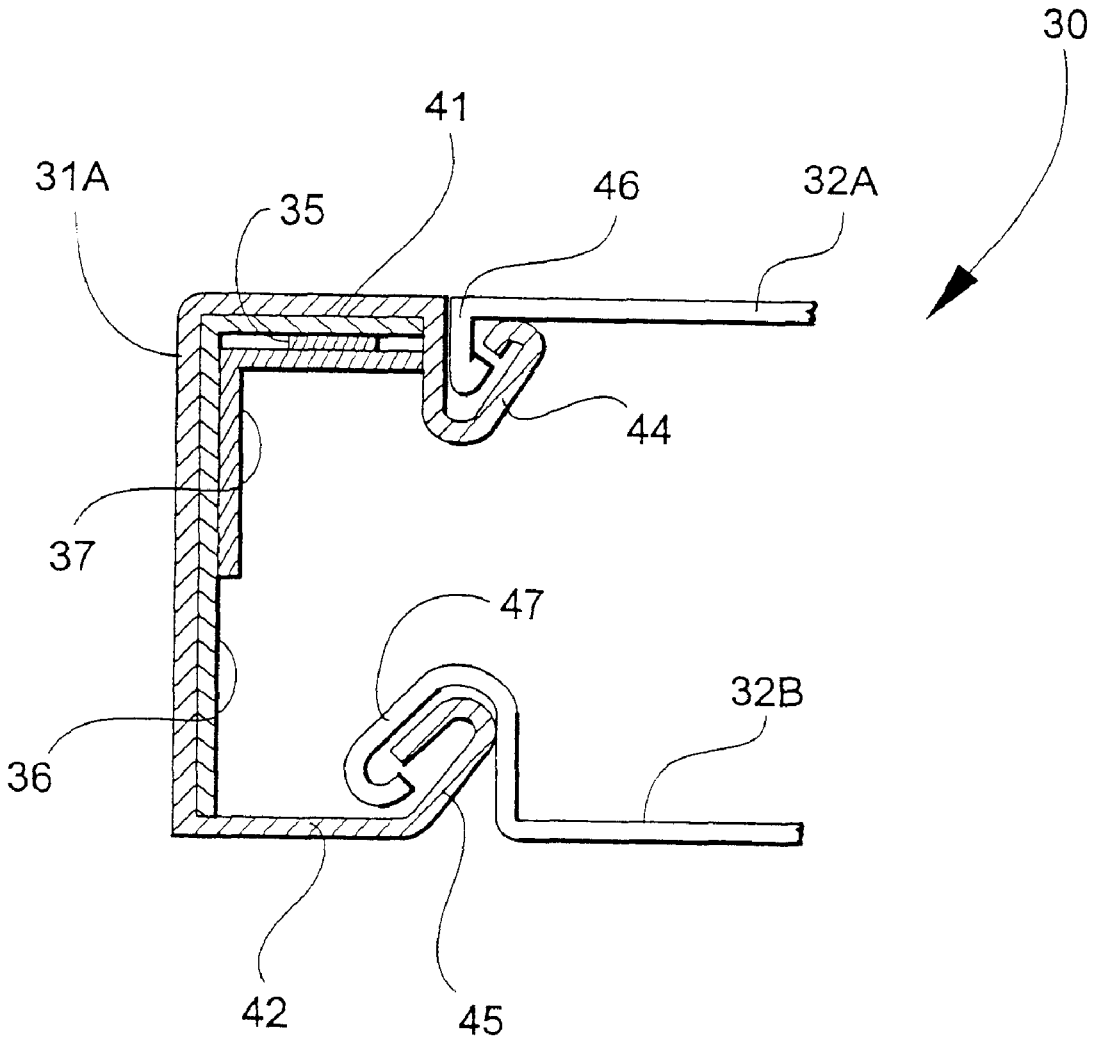
FIG. 7 shows a fragmentary, lateral cross-section of the beam and attached panels.

A further embodiment of a structural member 30 according to the present invention is shown in FIGS. 6 and 7. The structural member 30 is constructed of identical, spaced-apart, light-gauge steel beams 31A and 31B, top and bottom panels 32A and 32B attached to the beams 31A, 31B, and a number of spaced-apart lateral cross braces 34A–34F. Each beam 31A, 31B includes a tensioned steel strap 35 and a vertical tensioning post 36. The strap 35 is attached to opposing ends of each beam 31A, 31B using crimped anchor plates 36 and 37, as previously described.

As shown in FIG. 7, the longitudinal side edges of the flange members 41 and 42 have integrally formed hooks 44 and 45 which mate with complementary hooks 46 and 47 formed with the top and bottom panels 32A and 32B. The complementary hooks 44, 45, 46, and 47 allow ready and convenient assembly of the structural member 30 without risking penetration of the tensioned strap 35 with fasteners entering through the panels 32A, 32B and into the flange members 41 and 42.

A third embodiment of a structural member 50 forming a beam assembly according to the present invention is shown in FIGS. 8–11. The structural member 50 is constructed of a light-gauge steel beam 51 having a generally V-shaped or U-shaped cross-section. The range of steel thickness is preferably between 16 and 20 gauge. The beam 51 includes a bottom 52, opposing sides 53 and 54 integrally-formed with the bottom 52, and respective flanges 55 and 56 integrally-formed with the sides 53 and 54. The flanges 55 and 56 preferably include longitudinal fastener grooves 58 (See FIG. 11) for guiding suitable fasteners used for attaching the structural member 50 to other building members. The longitudinal edges 61 and 62 of the flanges 55 and 56 are folded downwardly to provide increased compression strength. A flat, pretensioned, stress-proof steel strap 64 is secured in tension to opposing ends of the beam 51 by cooperating pairs of anchor plates 66, 67 and 68, 69. The strap 64 is pulled downwardly at a center point of the beam 51, and is held adjacent the bottom 52 by a vertical tensioning post 71 attached to the opposing sides 53 and 54. The tensile strength of the strap 64 is between 100,000 and 140,000 psi.

Figure 9:
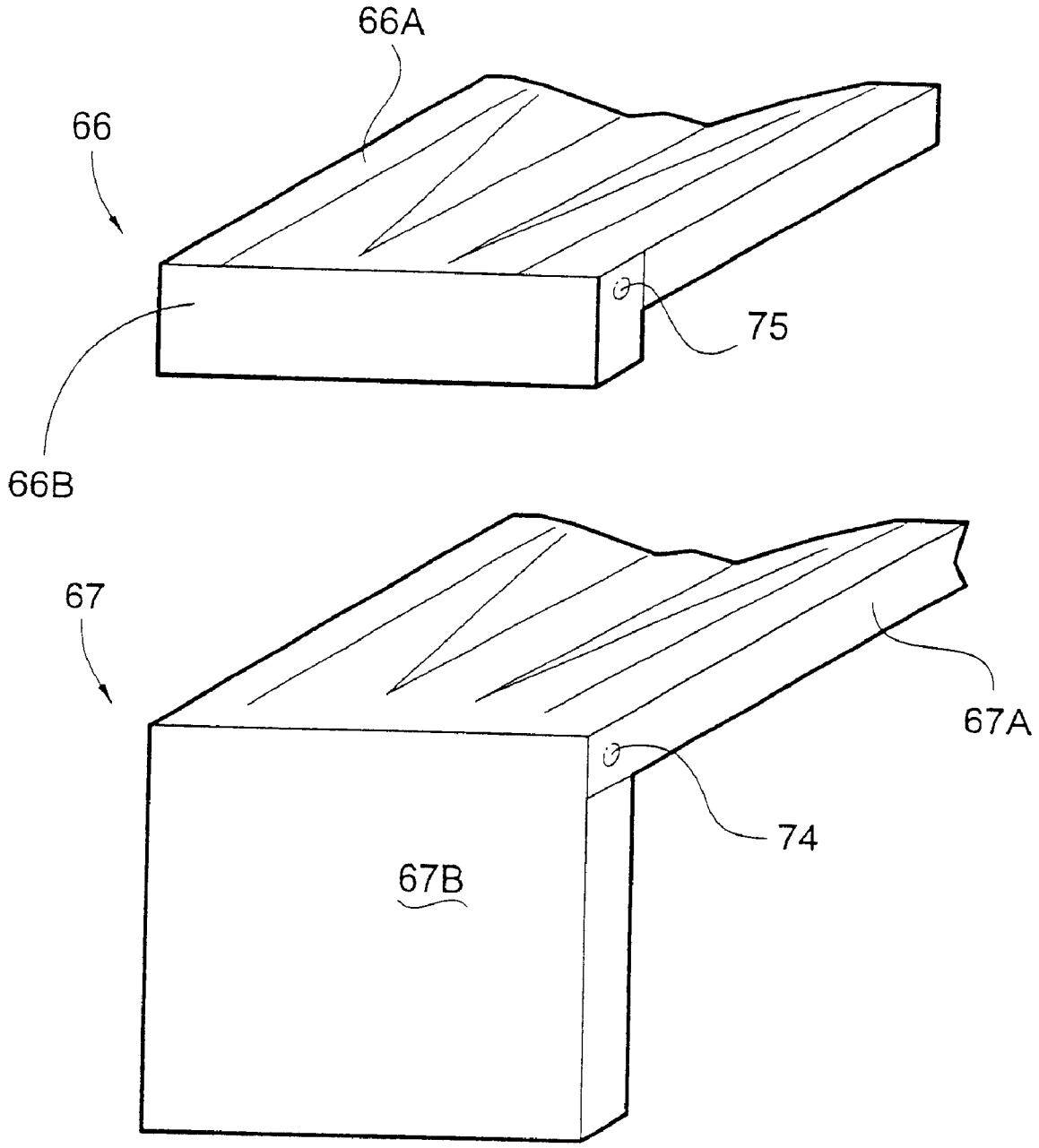
FIG. 9 is an exploded view of the upper and lower anchor plates.
Figure 10:
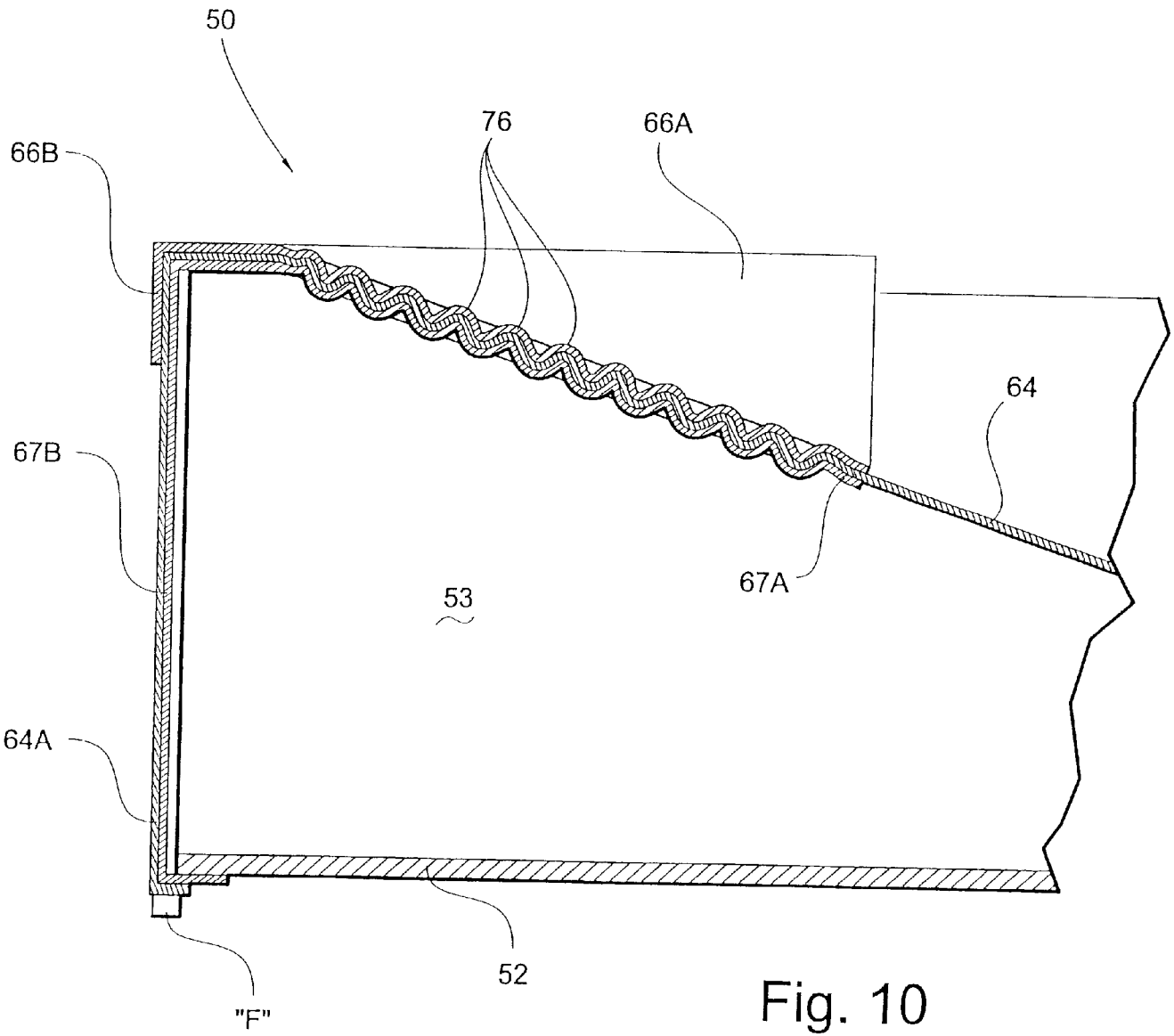
FIG. 10 shows a fragmentary, longitudinal cross-section of the structural member.

Referring to FIGS. 8–10, the lower anchor plate 67 is formed of light-gauge steel bent at an angle to form top and end sections 67A and 67B. The side edges of the sections 67A and 67B are folded perpendicularly inward, and are riveted together at an overlapping common point 74 to form a rigid connection. The top section 67A is angled downwardly towards the bottom 52 of the beam 51 to provide a sloping bed for holding the strap 64. The upper anchor plate 66 is likewise formed of light-gauge steel which is bent at an angle to form top and end sections 66A and 66B. The side edges of the sections 66A, 66B are folded perpendicularly inward, and are riveted together at an overlapping common point 75. The top section 66A is formed at an angle identical to that of the top section 67A of the lower anchor plate 67. The end section 66B resides adjacent the end section 67B of the lower anchor plate 67.

As best shown in FIG. 10, the upper and lower anchor plates 66 and 67 cooperate to sandwich and frictionally hold the tensioned strap 64 to the beam 51. The respective top sections 66A and 67A include a series of mating crimps 76, as described above, which engage the tensioned strap 64 to further increase the friction holding strength of the anchor plates 66 and 67. The crimps 76 are preferably stamped into the top sections 66A and 67A and tensioned strap 64 simultaneously prior to attaching the anchor plates 66 and 67 to the beam 51. The free end 64A of the tensioned strap 64 extends from the upper anchor plate 66 downwardly along the end section 67B of the lower anchor plate 67, and is attached to an inwardly turned bottom edge of the lower anchor plate 67 using a suitable fastener "F". Because the free end 64A of the strap 64 is essentially tension-free, penetration at this point does not weaken the holding strength of the strap 64. The gradual crimp pattern and crimping technique are preferably identical to that previously described. In addition, anchor plates 68 and 69 are identical to plates 66 and 67, respectively, and function in an identical manner to hold the opposite end of the tensioned strap 64 to the beam 51.

Figure 11:
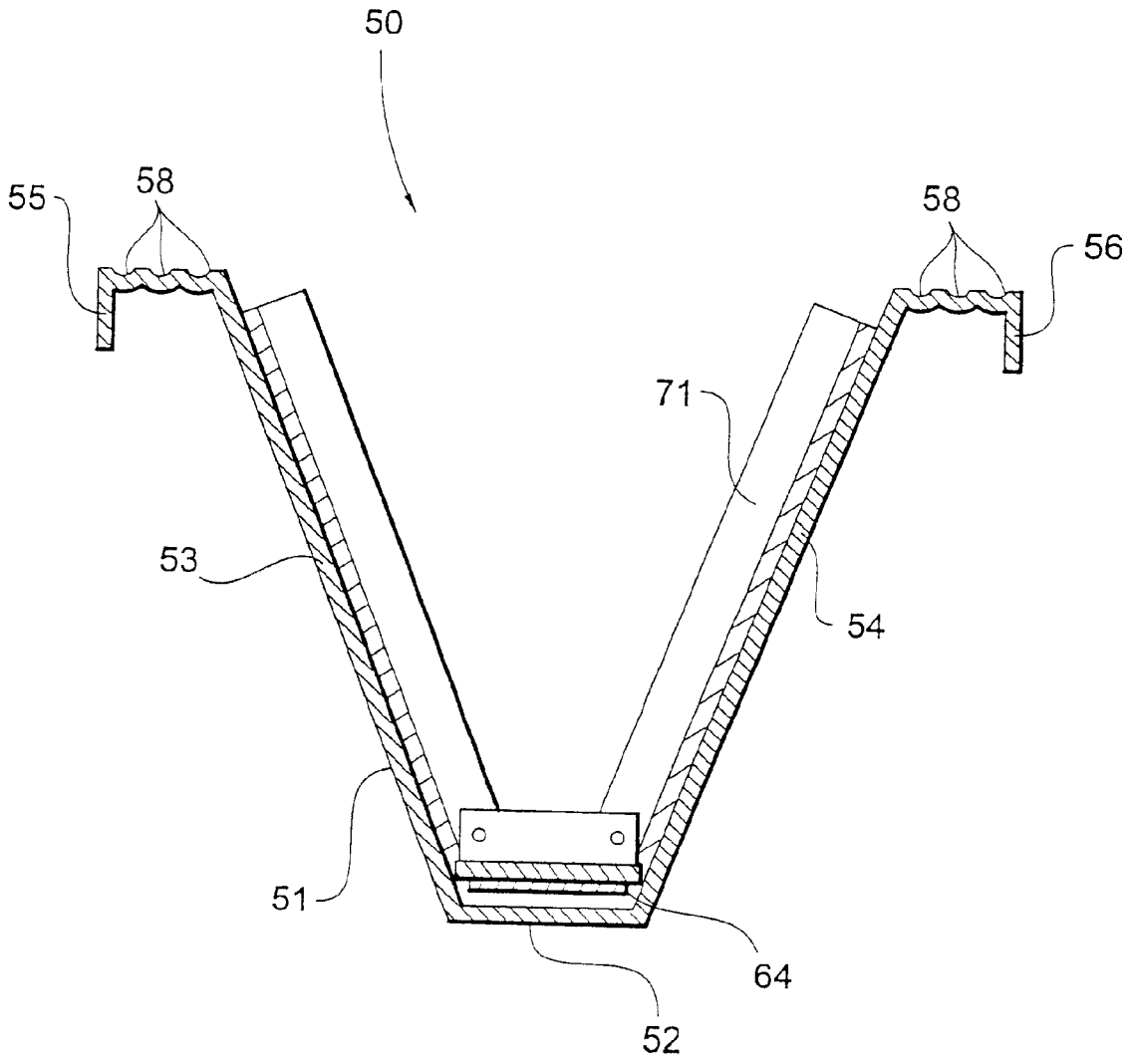
FIG. 11 shows a lateral cross-section of the structural member taken at its center point.
Figure 12:
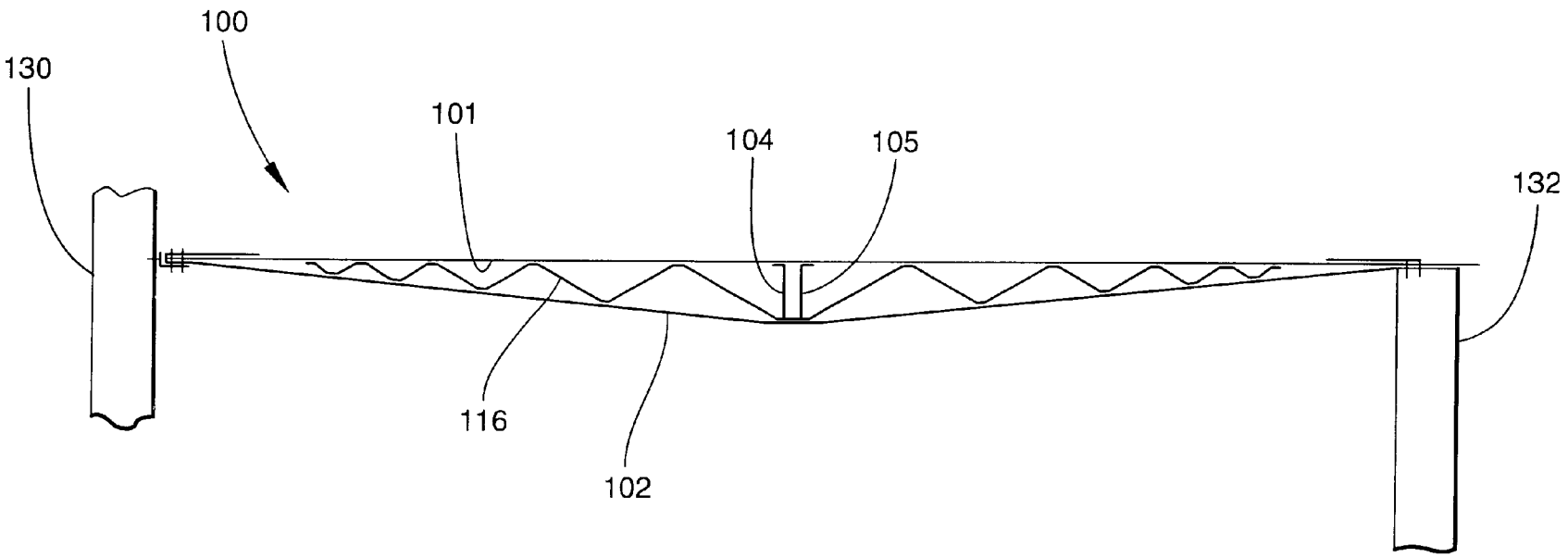
FIG. 12 is a side elevation of a bar joist incorporating the tension strap principle of the present invention.

The vertical tensioning post 71 is formed of a steel U-channel cut and folded in the center to fit against the sides 53 and 54 of the beam 51. The overlapping flange portions of the U-channel are preferably riveted together for increased stiffness. The post 71 is applied to the beam 51 after the desired lineal tension is pulled on the strap 64 and the ends of the strap 64 anchored to the beam 51, as described above. The strap 64 is forced vertically downwardly at a center point of the beam 51, and the tensioning post 71 mounted to the side walls 53 and 54 to hold the strap 64 in position adjacent the bottom 52 of the beam 51. As shown in FIG. 11, minimal clearance is provided between the strap engaging end of the post 71 and the bottom 52. The end of the post 71 is sufficiently wide to engage the entire width of the strap 64.

Because of substantial tension in the strap 64, the supporting reaction force on the structural member 50 is greatest at the location of the tensioning post 71. Thus, with its ends supported vertically, the structural member 50 is capable of carrying a maximum lateral load at its center point. The tensioned strap 64 effectively transfers this load to the supported ends of the beam 51. The structural member 50 is weakest at respective mid-points between the location of the tensioning post 71 and ends of the beam 51.

The horizontal and vertical tension forces applied to the strap 64 are preferably marked directly on a surface of the beam 51 to indicate the strength of the structural member 50. For added strength, the structural member may include one or more additional straps and tensioning posts.

Bar Joist Assembly

Figure 13:
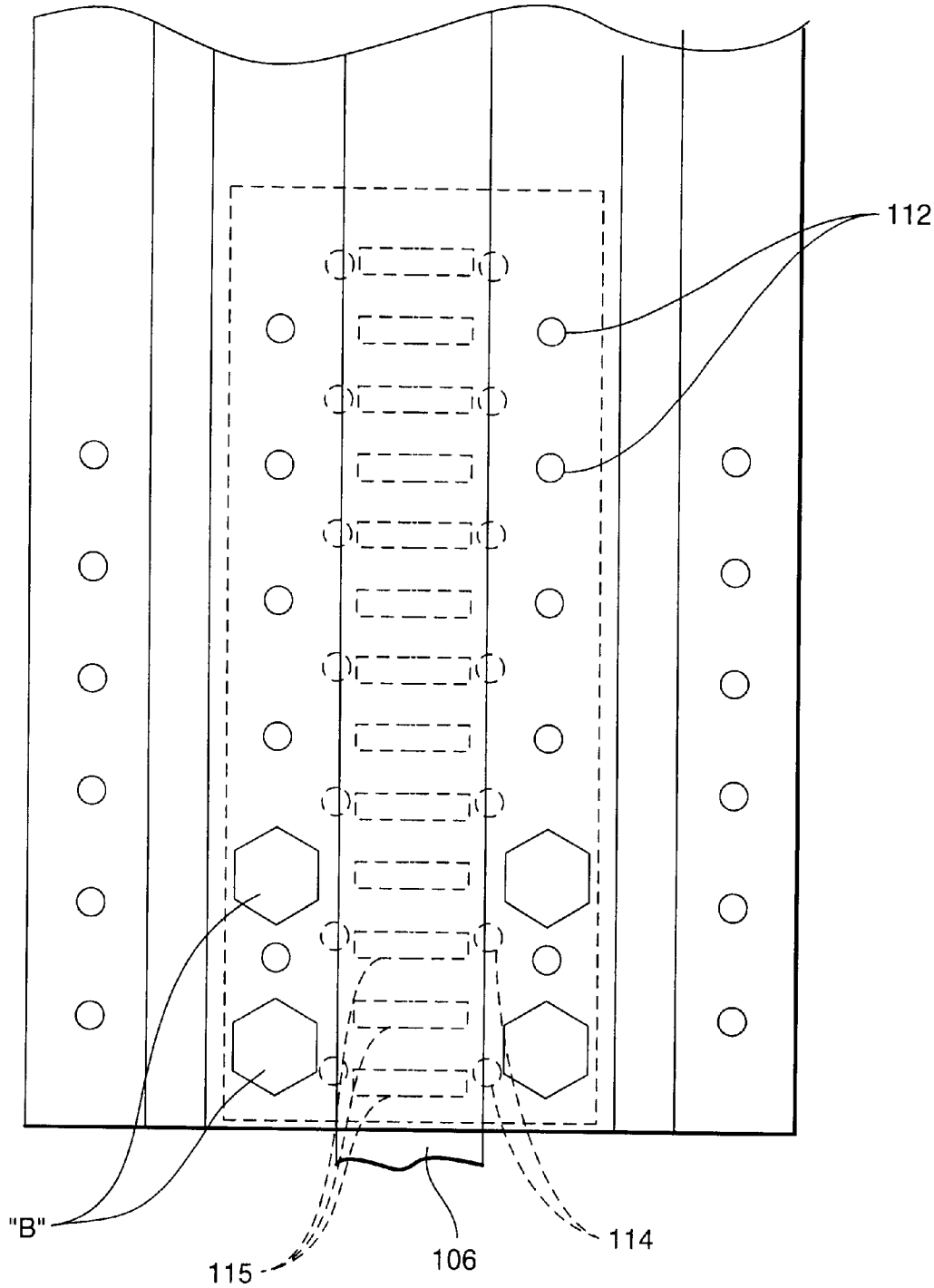
FIG. 13 is a fragmentary plan view of the bar joist showing the clamping assembly at one end of the bar joist.
Figure 14:
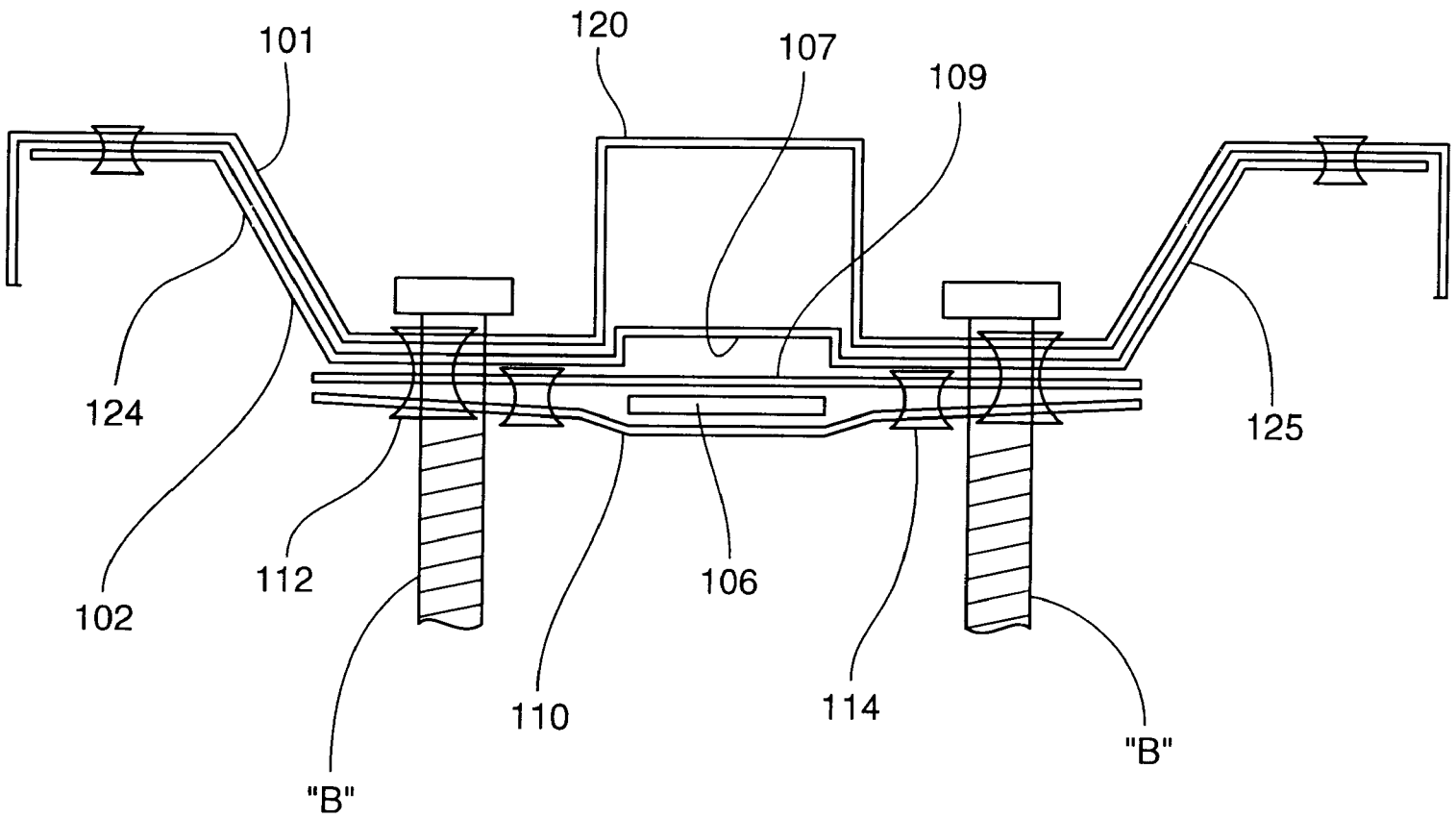
FIG. 14 is an end view of the bar joist.
Figure 15:
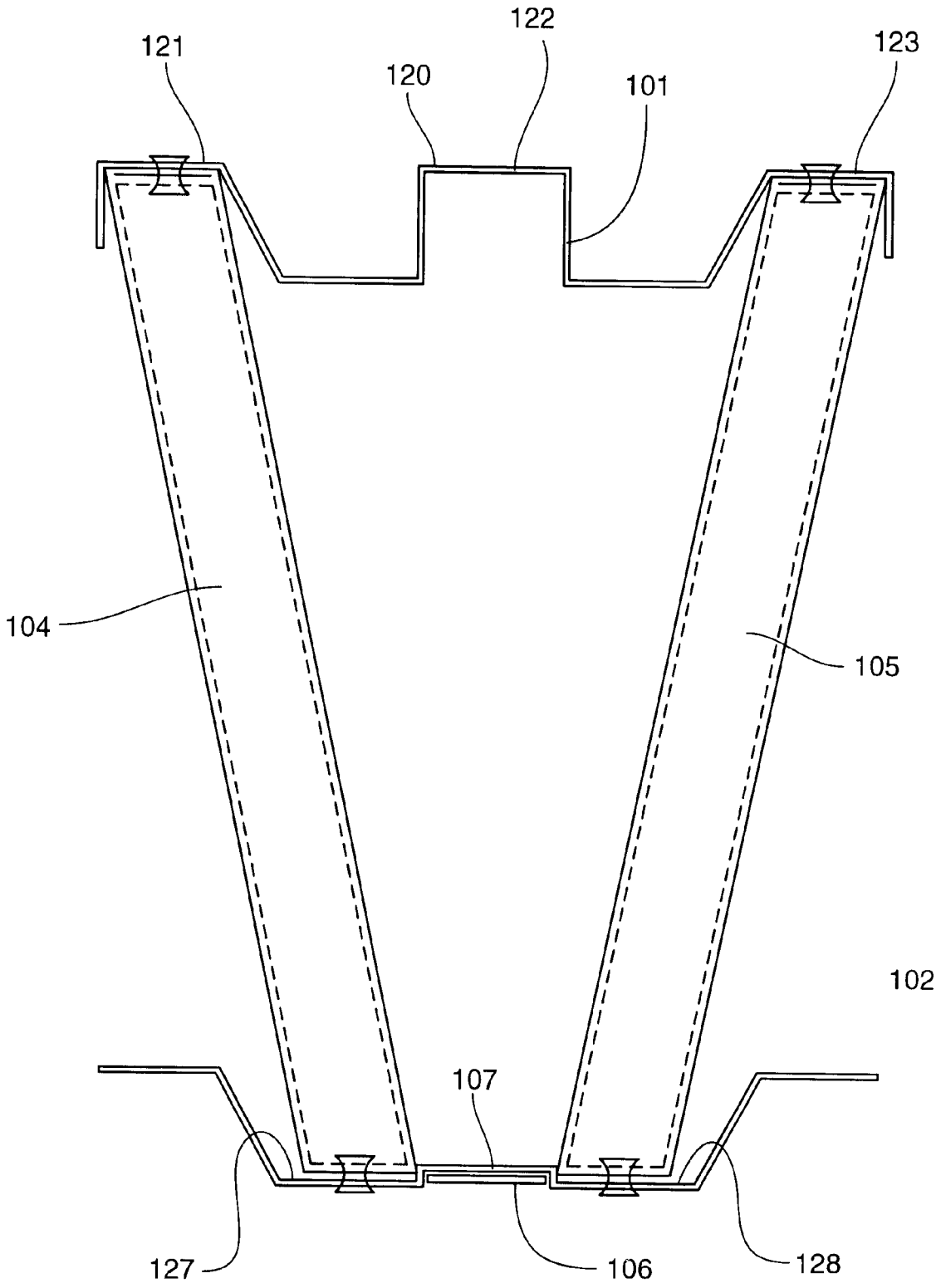
FIG. 15 is a sectional view taken at the center of the bar joist.

A bar joist assembly 100 embodying the principle of the present invention is illustrated in FIGS. 12–15. The bar joist assembly 100 includes top and bottom elongated sheet metal cords 101 and 102 joined together at respective opposing ends and spaced apart at a center point using vertical tensioning posts 104 and 105, as shown in FIG. 15. A metal tension strap 106 is positioned within a strap-receiving channel 107 formed with the underside of the bottom cord 102 and extends along the outside of the bottom cord 102 from one end of the bar joist assembly 100 to the other. The tension strap 106 is secured at opposite ends of the bar joist assembly 100 by cooperating top and bottom metal anchor plates 109 and 110 attached to the cords 101 and 102 by sets of rivets 112. As best shown in FIG. 13 and 14, the rivets 112 attach the top and bottom anchor plates 109 and 110 together on opposite sides of the tension strap 106, while rivets 114 attach the anchor plates 109 and 110 to the top and bottom cords 101 and 102. For added holding strength, the ends of the bar joist assembly 100 further include a serious of crimps 115 formed in the top and bottom cords 101, 102, anchor plates 109, 110, and strap 106 to frictionally secure the strap 106 to the cords 101, 102 without the use of strap-penetrating fasteners. First and second lengths of thin metal tubing 116 are located between the top and bottom cords 101, 102 and are bent, respectively, to alternately engage the top and bottom cords 101, 102 along the length of the bar joist assembly 100. The bent tubing 116 serves to transfer the weight applied to the top cord 101 down to the tension strap 106 under the bottom cord 102, and to reduce any spring that might occur in a relatively long span bar joist assembly 100. The pitch angle and spacing of the tubing 116 for fastening is engineered for each separate application.

As best shown in FIG. 14, the top and bottom cords 101, 102 are configured in overlying relation at respective ends of the bar joist assembly 100, and to create compression strength in a lengthwise direction. The top cord 101 defines an integrally-formed center cap 120 and three flat surfaces 121, 122, and 123 adapted for providing a double support for sheeting, decking, roof panels, and the like. The relatively high center cap 120 also serves as a shield to protect against penetration of fasteners through the top cord 101 and into the tension strap 106. The high-walled grooves 124 and 125 formed on an underside of the top cord 101 along opposing marginal edges provide a track within which the bent metal tubing 116 is received and fastened. The bottom cord 102 defines respective inside channels 127 and 128 for receiving and fastening opposing ends of the bent metal tubing 116 to the bottom cord 102.

Preferably, the top and bottom cords 101, 102 and metal tubing 116 are assembled prior to attachment of the tension strap 106. The top and bottom cords 101, 102 are placed in a jig, and one end fastened together using metal rivets. The bottom cord 102 is then formed over the tensioning posts 104, 105 and attached to the top cord 101 at the opposite end of the assembly. The metal tubing 116 is formed in an off-line press to create the desired configuration, and is placed between the top and bottom cords 101, 102. The tubing 116 is pushed inwardly towards the center of the assembly 100, and is fastened at the top and bottom cords 101, 102 using rivets or other suitable fastening means starting at the tensioning posts and anchoring outwardly toward the ends. In the preferred embodiment, two parallel rows of metal tubing 116 are used to provide greater stand alone stability to the bar joist assembly 100. In another embodiment, a single row of tubing is fastened at the center of the bottom cord and configured to alternately engage the top and bottom cords from one end of the bar joist assembly to the other. This embodiment is especially applicable in the construction of a pre-engineered panel with multiple bar joist assemblies and spreaders to keep the joists from twisting. The depth or girth of the bar joist assembly 100 is determined based on the length of the span and the live load requirements of the particular application. For example, a simple single span joist 30 feet long could have a girth of only a few inches, whereas a longer span structural application could have a girth of several feet.

After assembly of the top and bottom cords 101, 102 and metal tubing 116, the tension strap 106 is anchored at one end of the cords using anchor plates, rivets, and crimps, as previously described. The strap 106 is then positioned within the strap-receiving channel 107 of the bottom cord 102, and extended to the opposite end of the joined top and bottom cords 101, 102. The assembly 100 is then placed in a tensioning machine and a predetermined amount of tension pulled on the strap 106. An electronic tensioning scale measures the tension in the strap 106, and is operatively connected to a computer which controls operation of an etching needle. The etching needle inscribes the critical manufacturing and tensioning information onto the bar joist assembly 100 in a conspicuous location readily viewable after the bar joist assembly is placed in final construction. While in tension, the second end of the strap 106 is anchored in an identical manner using anchor plates, rivets, and crimp.

In the embodiment shown, one end of the bar joist assembly 100 is secured to a continuous wall 130 using a joist hanger angle iron and bolts "B", while the opposite end is attached to the top of a wall 132 using anchor bolts or other suitable means. In long span, heavy load structural applications, a suitable tensioning system adapted for use at the job site is employed to tension the heavy gauge strap, or flat bar. In all applications of the invention, care is taken to avoid damaging or penetrating the tension strap 106 in areas where the strap is in tension.

Reinforced Vertical Wall Member

In a further embodiment, a structural member (not shown) embodying the principle of the present invention is applicable for reinforcing vertical walls against inward and outward loads. For outward loads, such as wind loads, the structural member is oriented such that the tension strap is anchored on the windward side of the vertical wall and the tensioning posts anchored on the leeward side. In cases where reinforcement is needed for both wind loads and pressure loads on the inside, such as for grain storage silos, a double tension strap is used. One strap is anchored to the outside at one end of the structural member, and is given a half-twist at the tension post located at the center point of the member and another half twist at the opposite anchored end of the member. The second strap is anchored at the opposite side of the structural member, and is likewise given a half-twist at the tension post and another half twist at the opposite anchored end of the member. The tension post is adapted for anchoring only to the sides of the structural member such that the tension strap can pass over both ends of the post. The half twist in each strap allows the straps to pass each other at the one-quarter and three-quarter points along the vertical member. A thin, flat piece of rubber or plastic is preferably inserted between the straps where the straps pass each other to avoid any possibility of friction damage to either strap.

Heavy Steel Structural Beam Assembly

Figure 16:
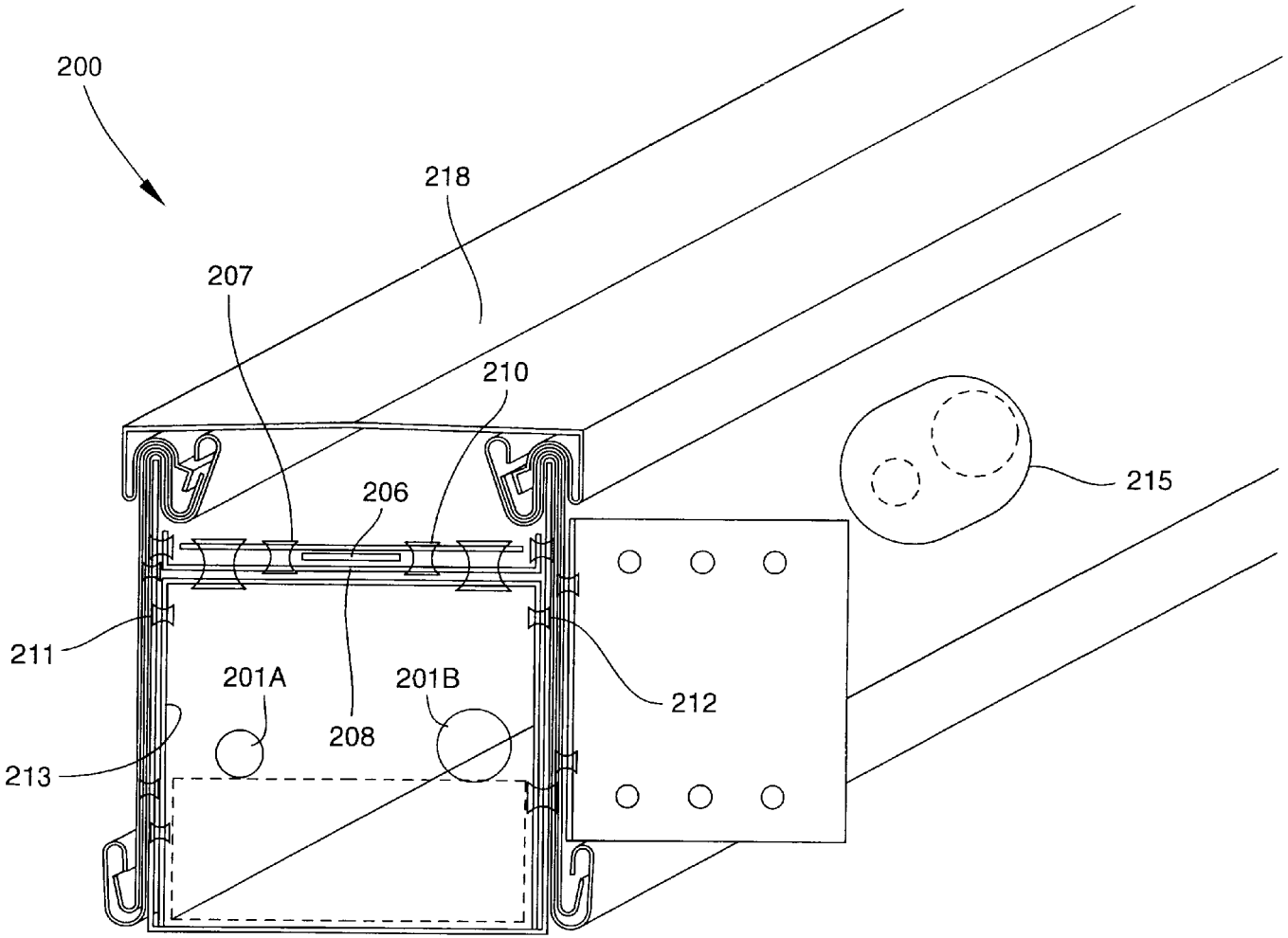
FIG. 16 is a fragmentary perspective view of a heavy steel beam incorporating the tension strap principle of the present invention.
Figure 17:
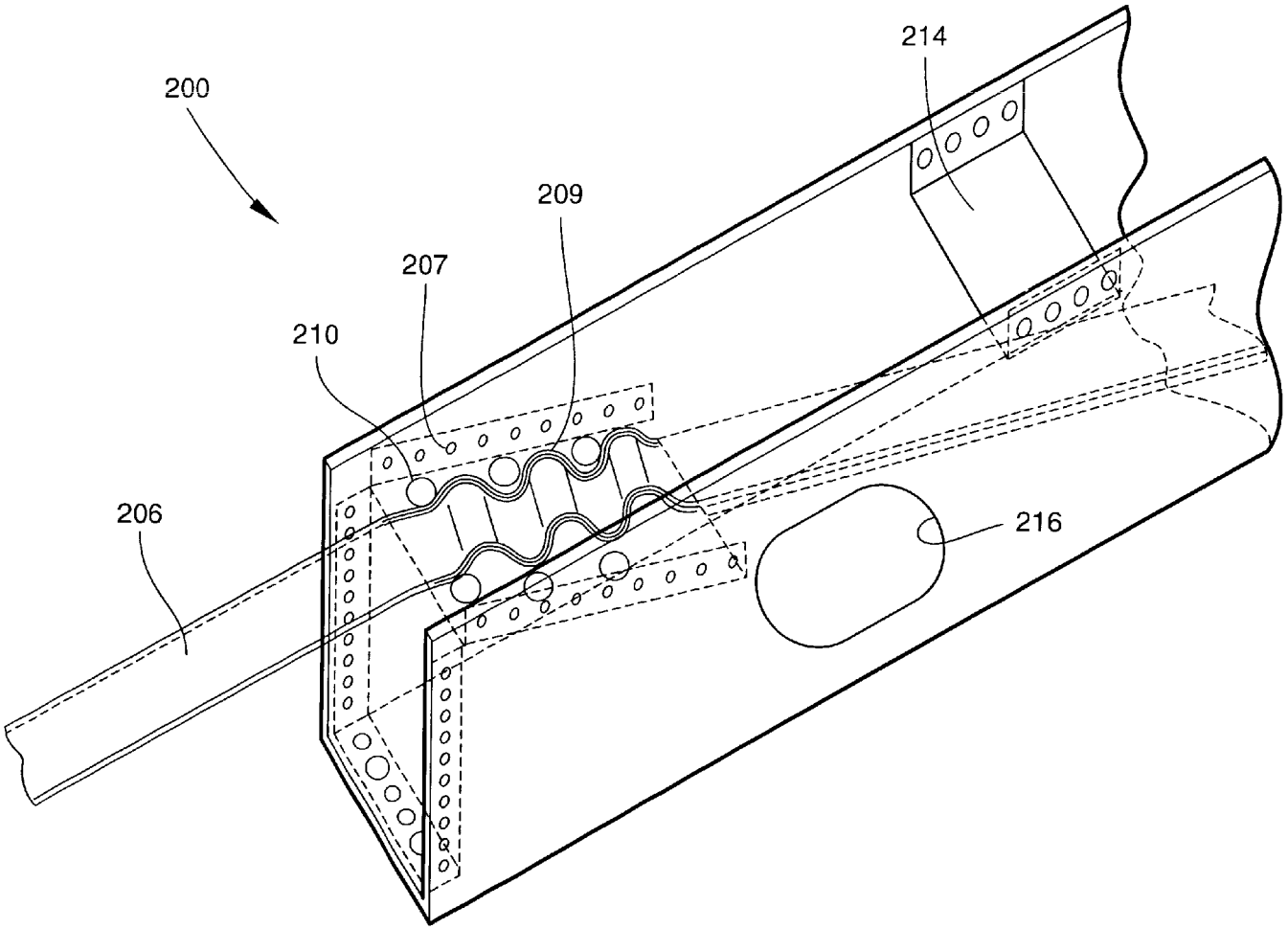
FIG. 17 is a fragmentary perspective view of the heavy steel beam with the rain cap removed to illustrate the clamping assembly of the beam.

Referring to FIGS. 16 and 17, the principle of the invention is likewise applicable for constructing a heavy steel structural beam assembly 200. In this application, the steel is engineered heavier to withstand increased load demands. A suitably designed beam assembly 200 can serve as a carrying chamber for electricity, fire suppression pipes or water pipes, such as indicated at 201A and 201B. The beam assembly 200 of this embodiment is relatively wide to accommodate access to piping for hook up. In addition, a snap together principal can be incorporated into the beam structure to receive snap-in-place roof panels.

A U-beam is generally more functional than the conventional I-beam. In this embodiment, an elongate strip of flat metal from ten gauge to several fractions of an inch thick is bent or rolled into a "U" shape. An tension strap 206, such as described above, is tensioned and anchored to the sides of the U-beam using anchor plates 207 and 208, crimps 209, and rivets 210. When using a heavy steel strap or flat bar, the crimps 209 are formed separate in heavy presses, and are bolted or riveted together at 211 and 212 to form the assembly. It may also be necessary to insert a reinforcing member 213 to add vertical support to the anchor assembly in a wide beam application. Cross brace or spreading bars or cripples 214 are preferably attached across the U-beam proximate the open top to keep the top from spreading or collapsing when the tension is applied to the strap and the beam is loaded.

A metal panel formed of a lighter gauge material is hooked over the top of the U-beam and attached to the side of the beam in several locations to strengthen the vertical wall of the beam and hold the roof panel secure to the beam. Access holes 215 and 216 formed in the sides of the beam and the metal plate are arranged in alignment with access holes and piping in the roof panel to permit the passage of the piping. A snap together hanger plate with "V" type catches formed in each side is attached to each side of the U-beam. The hanger plate is also attached to the roof panel using clinches or rivets so that the roof panel can slip into the configured sockets extending from the U-beam. The roof panel is bent on the ends to fit over the top edge of the U-beam and into the snap clip. The space around the clips allows for expansion and contraction of the roof.

A rain cap 218 is formed to fit over the beam and the end of the roof panel with the inside edge formed to snap into the snap together clips behind the roof panel. The rain cap is preferably designed so it can be removed from the beam for servicing. The rain cap clips also provide a system for spreading the roof panel in the snap together socket so that it cannot come out. The void inside the beam around the tension strap and a piping would be filled with insulation. An insulation bed can be placed in the bottom of the beam to support the pipes and provide give for expansion and contraction of the pipes. In an application where the snap together principal was not used and a purlin needed to set on the beam, the top of the vertical sides of the beam would be bent either in or out to provide a bed for the purlin to set on and be anchored to the beam.

Reinforcing a Deep Grooved Roof or Deck Panel

Figure 18:
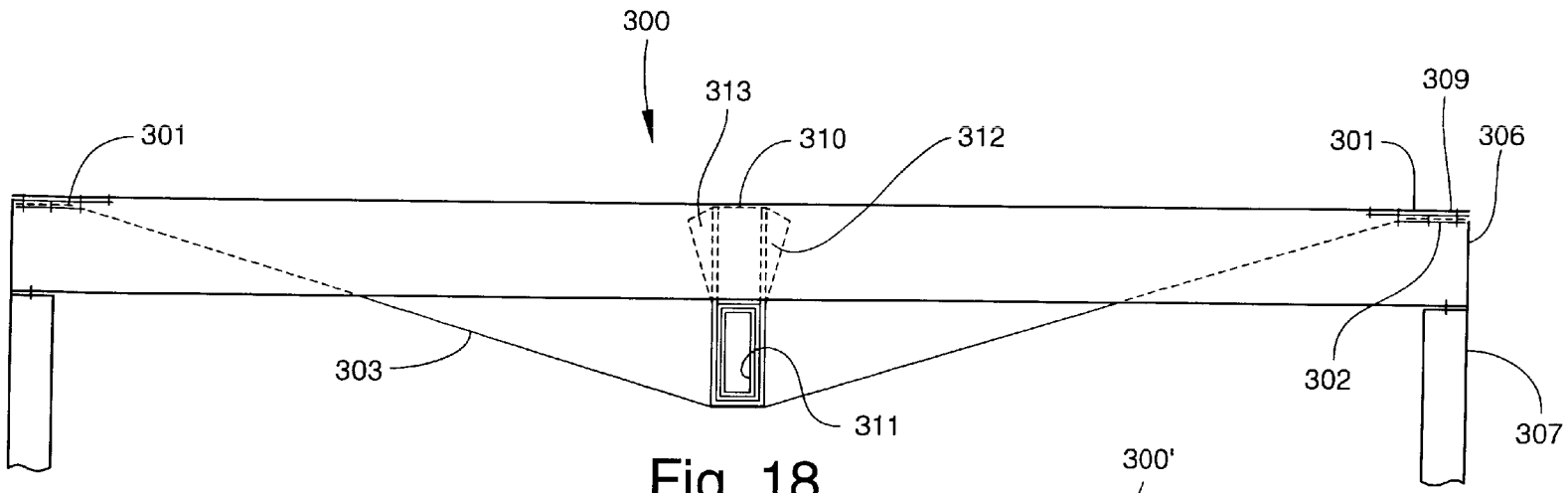
FIG. 18 is a side elevation of a reinforced deep groove roof or deck panel incorporating the tension strap principle of the present invention.
Figure 19:
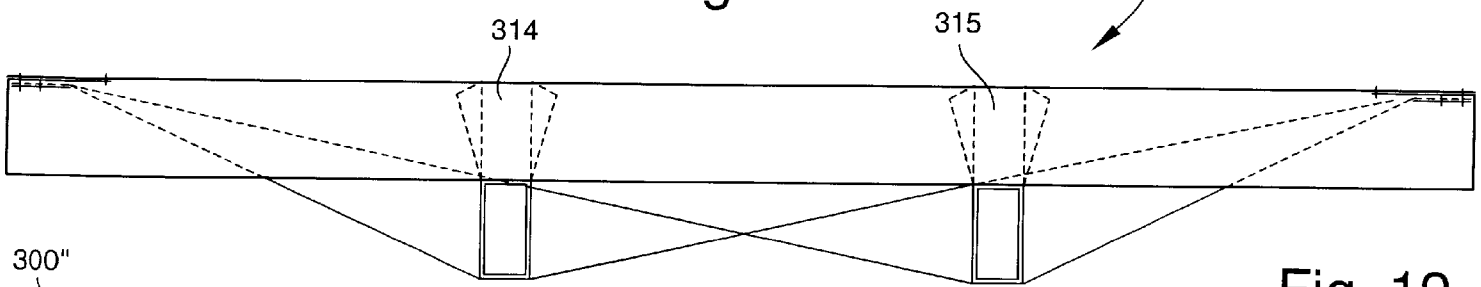
FIG. 19 is a side elevation of a reinforced deep groove roof or deck panel according to another preferred embodiment of the invention.
Figure 20:
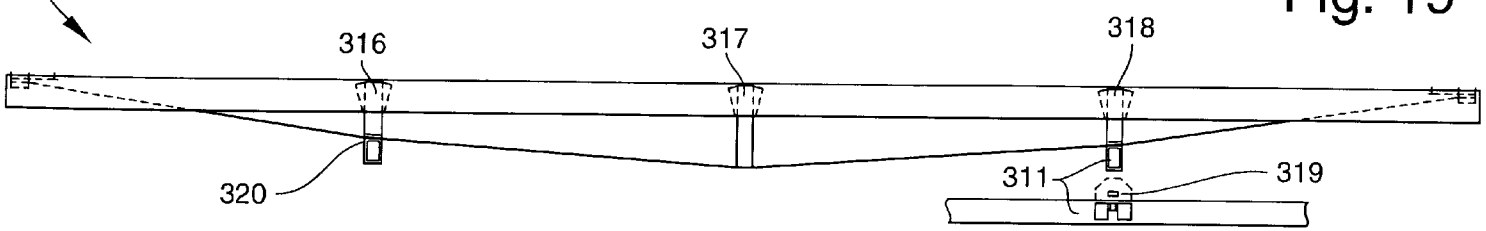
FIG. 20 is a side elevation of a reinforced deep groove roof or deck panel according to a third preferred embodiment of the invention.
Figures 21, 22:
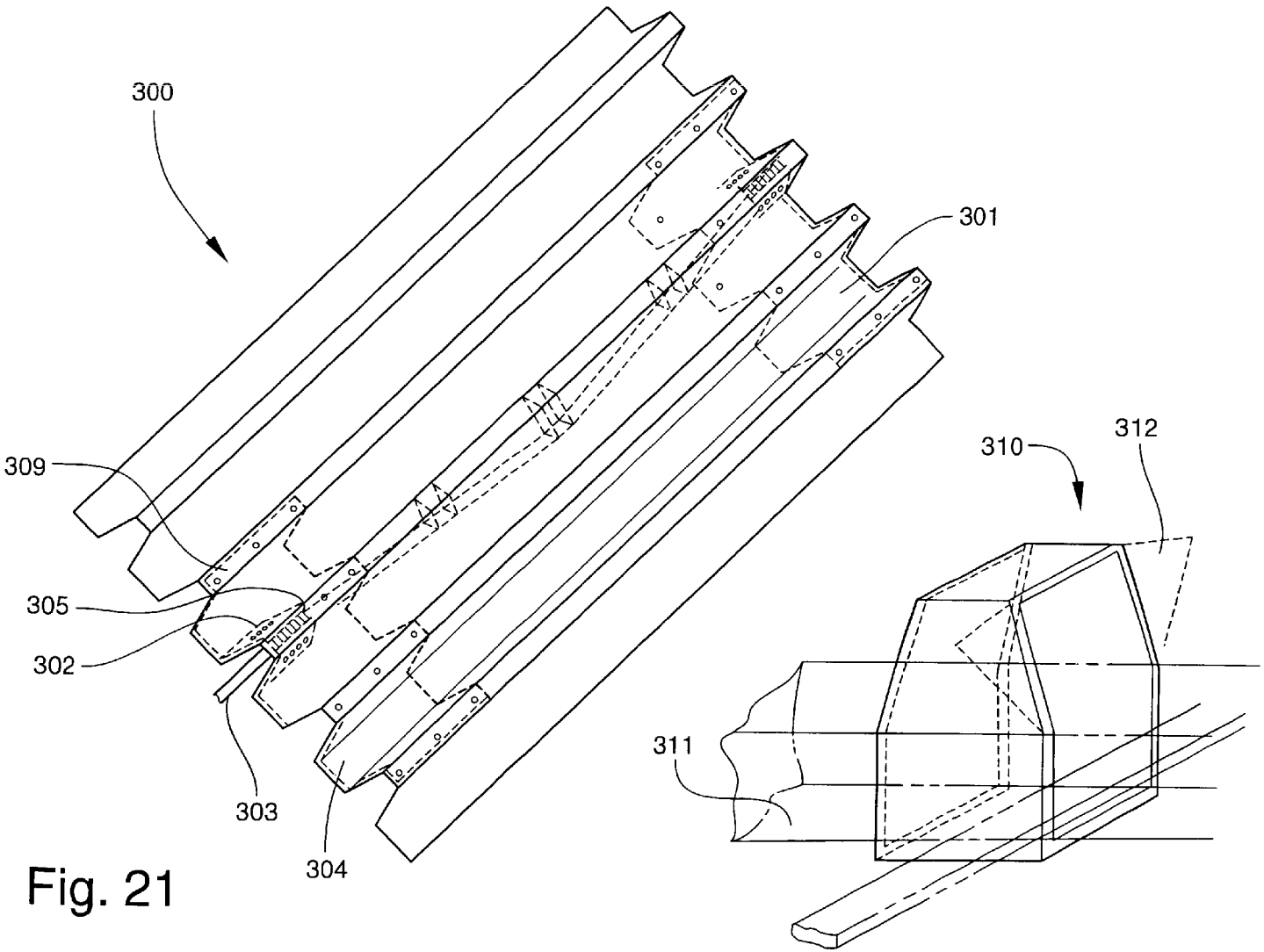
FIG. 21 is a reduced, perspective view of the deep groove roof or deck panel.
FIG. 22 is a fragmentary perspective view showing the tension post used in deep groove roof or deck panel.

Referring to FIGS. 18–22, a deep groove roof panel 300 with 4–6 inch grooves can be used in extended clear span applications with the use of a strength-reinforcing tension strap according to the principle of the invention described above. FIG. 21 shows a corner view of the deck panel. FIGS. 18, 19, and 20 show side views of respective deck panels 300, 300', and 300" with the tension strap in place. A second piece of panel of the same configuration is cut to form a reinforcing plate 301. The width and length of the reinforcing plate is determined by the lead and span requirements of the application. The tension pressure placed on the panel by the tension strap must be disbursed into the panel without buckling. A second plate 302 with a strap 303 sandwiched in-between like plate 304 and clinched and crimped 305 in a similar manner as previously described is assembled to form the end. Salvage ends 306 of the strap 303 can extend beyond the panel to be used as hurricane fastening straps 307. The end of the tension strap is fastened to the panel at 309. A central point tensioning post 310 is glued and/or screwed to the underside of the panel. As shown in FIG. 22, the tension post 310 is configured to be slightly larger than the cross joist so that a cross joist 311 can slip into it. A basic rectangular tube with the top corners folded back at 312 to fit the contour of the panel 300 is glued and/or screwed 313 to the underside of the panel. The tension strap is aligned under the tension post. A rubber or plastic pad is placed between the strap and the post. In longer span requirements, a double tension post 314, 315 can be used. The tension strap passes through the adjacent tension post and crosses over the top of the second joist without contacting the top of the joist or the second tension post. The strongest tension strap configuration is a basic triangle where the beam is the top leg of the triangle, while the strap forms the other two tension legs of the triangle.

In a further embodiment, three tensioning posts 316, 317, and 318 could be used to support long span roof panels. In this application, the straight plane of the strap legs of the triangle configuration would be altered slightly at 316 and 318 to absorb half of the load from the end to the center 317. Precise engineering would be required to keep the load on the strap uniform. The two outside tension posts would be made different from the center one. A notch 319 would be made in the two side tension posts to create a plane 320 through which the strap could pass. The strap would contact only the top of the notch. These two tension posts would be threaded onto the tension strap before the second end of the strap is assembled. The panel is placed in a tensioning machine. A predetermined tension would be pulled on the strap and the second end would be secured to the panel 309. The outside tension posts would serve as dead end joist hangers where the joist would be inserted into the tension post to a point just short of contacting the tension strap during roof assembly and then secured in place. The center tension post can serve as a pass through joist hanger.

In assembling the roof, the joist would be inserted in place as the deck is being placed on the end supports. This configuration would also create a situation where if there is more live load on 316 than there is on 318 a sag could be created at 316 and a hump could be created at 318 creating an uneven roof. At best a springier roof would probably be created. A bar joist beam as described above could be used to help eliminate this problem. Higher tensile strength strap material could also be required. If an insulated roof was desired, the tension strap could be secured between the top roof panel and a bottom ceiling panel to complete a finished interior.

Beam/Joist Assembly

In still another application of the invention, a series of assembly stations are erected on a 10 inch I-beam with an 8 inch top and bottom flange. The length would depend on the length of the joist to be built. These stations include a clamping device to clamp and hold the joist against the tensioning pressure. A scale and strap clamping combination station holds the strap for tensioning. An electronic scale is mounted in the front part of the station. A hydraulic cylinder pulling station is anchored to the end of the I-beam and attached to the tensioning station to pull tension on the strap. A tension post down pressure station measures the amount of vertical pressure being built into the strap at the tension post. A guide station at the end of the I-beam holds the beam (joist) during tensioning.

Clamping Device

Figure 23:
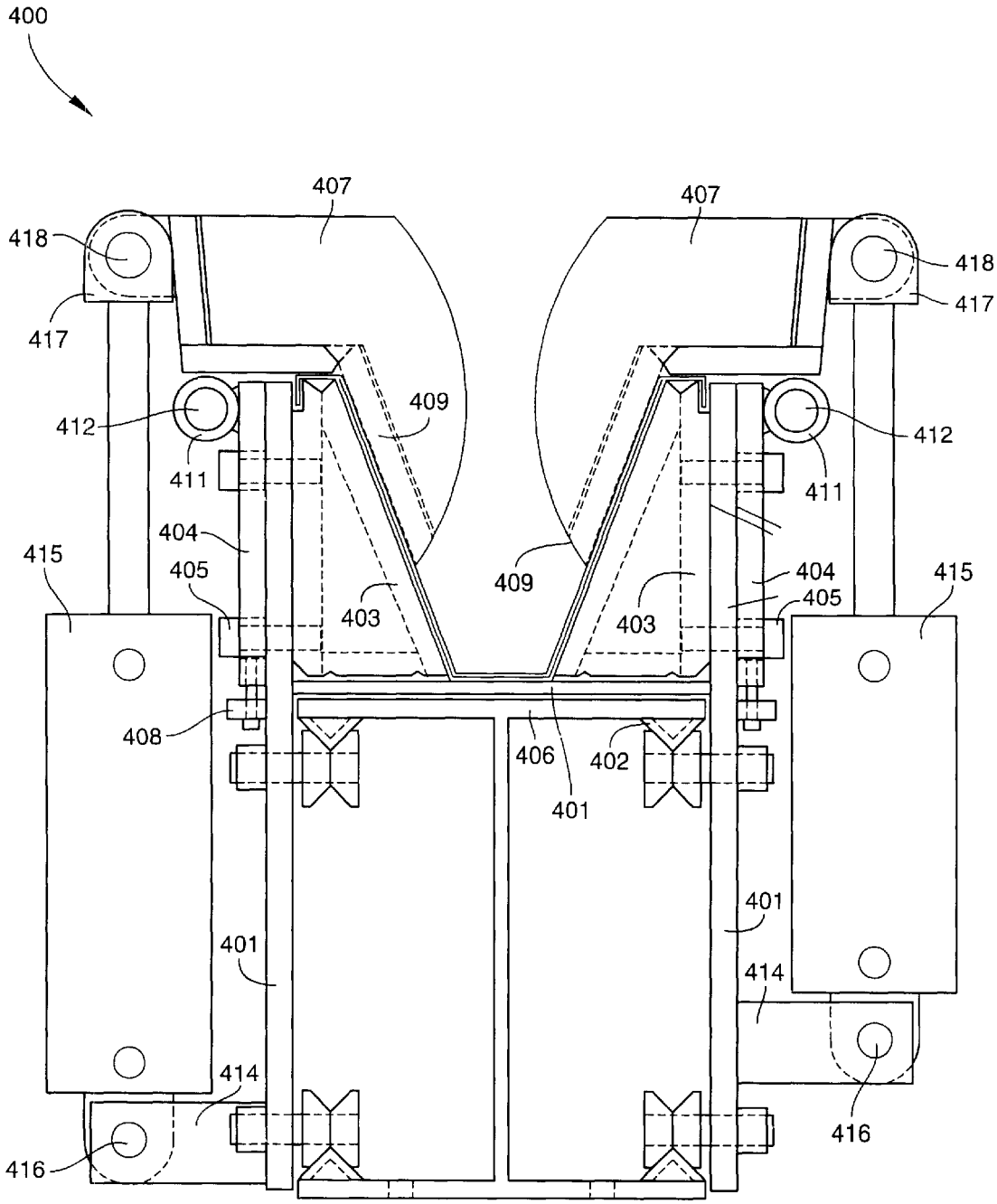
FIG. 23 is an elevational view of the clamping device used for holding structural member during tensioning of the tension strap.

FIG. 23 shows an end view of the clamping device 400 adapted for clamping and holding the joist against tensioning pressure. An H-frame 401 twelve inches long is welded to clear the I-beam. Four angle irons 402 are welded full length of the I-beam. V-rollers are bolted to the H-frame with rolling clearance against the angle irons to allow the station to roll freely up and down the I-beam. A clamping anvil 403 is welded to fit the configuration of the tension joist. A clamping plate 404 is drilled at 405 to hold the anvil to the H-frame 401. The anvils and clamping plates are shimmed in and out at 406 for fine adjustment for the clamp 407. A vertical adjusting bolt 408 is welded to the H-frame to adjust the clamp assembly up and down. A clamp 409 twelve inches long is welded to fit the shape of the anvil and the tension beam. The clamp is designed to clear the tension strap during the clamping and releasing operation. Six ¼ inch wall×1 inch ID×2 inch long steel tubes 411, 412 are fit and every other one is welded to plate 404 with the alternate ones welded to clamp 409 to form a scissors type hinge. A one inch piece of shafting is used for a hinge pin. An islet iron 414 is welded to the H-frame to hold the bottom end of a hydraulic cylinder 415 at 416. A second islet iron 417 is welded to the clamp assembly 409 to receive the rod end of the hydraulic cylinder. A ¾ inch pin 418 is used to connect the rod end of the cylinder to the clamp. Each different joist configuration requires a unique clamp assembly. When the cylinders are retracted the clamps will be open to permit loading and unloading of a joist. When the cylinder is extended the clamp is closed pressing the joist tight against the anvil to hold it while tension is being pulled on the strap against the joist. The clamp station is the third station in line on the tensioning beam.

Scale Hanger and Strap Clamp

Figure 24:
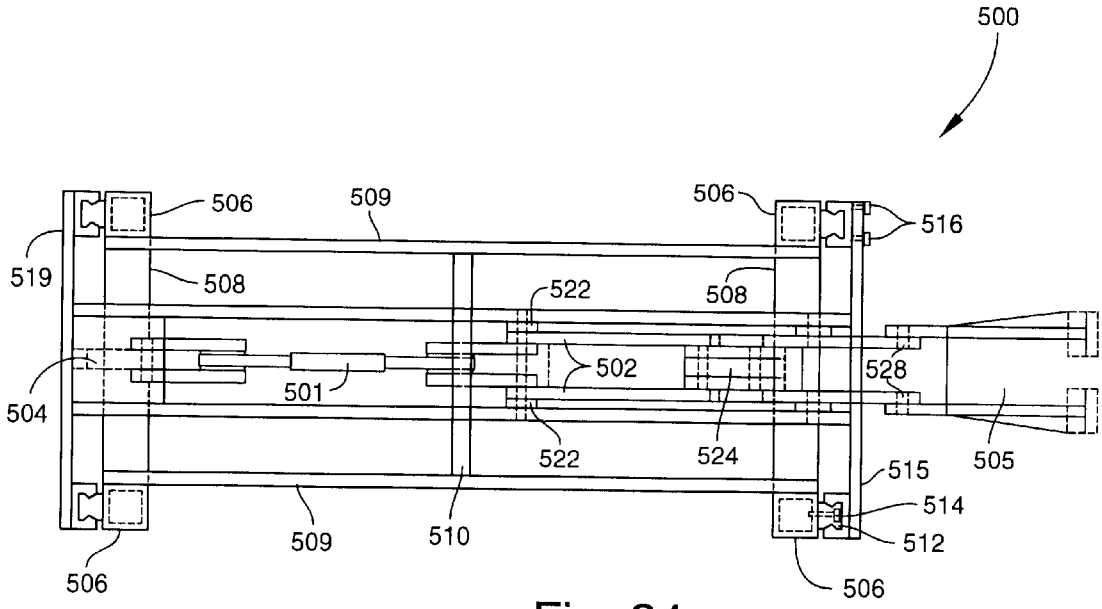
FIG. 24 is a top view of a scale tensioning device adapted for use in constructing a structural member according to the present invention.
Figure 25:
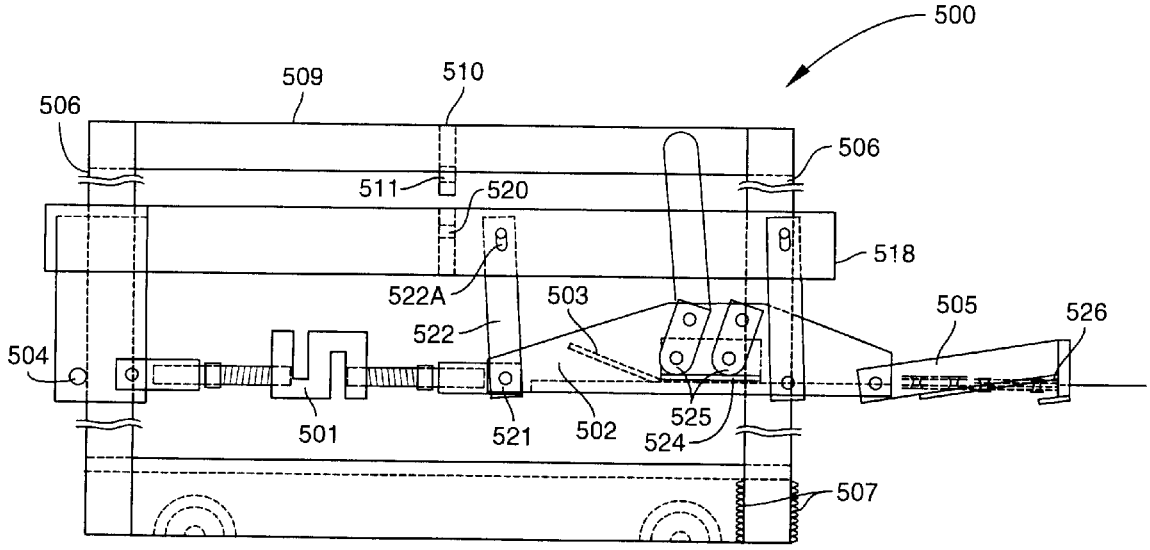
FIG. 25 is a side view of the scale tensioning device.

Referring to FIGS. 24 and 25, the scale hanger and strap clamp station 500 has a three-fold function. First, there is an electronic scale 501 to measure the amount of tension pulling on the strap. This figure is recorded on a computer which then drives an etching tool to permanently mark the tested strap tension into the side of the joist. Second, a strap clamp 502 clamps the strap 503 tight and holds the strap from moving. A hydraulic cylinder is attached at 504 to pull and hold tension on the station and strap while the anchor plates are fastened (clinched) to the joist. Third, a hook 505 extends over the inside of the anchor plate (See FIG. 9). Tension is pulled on the anchor plates through the electronic scale to ensure that the strap is clamped properly before fastening to the joist. This information is also etched into the side of the joist.

A trolley car is constructed with an H-frame and rollers as shown in FIG. 23. Four 2 inch×2 inch×¼ inch wall square steel tubes 506 are cut to house a 24-inch hydraulic cylinder and the tensioning scale and clamp approximately five feet. These tubes are welded 507 at the four corners of the trolley car. A cross frame 508 and side frame 509 are welded at the top of the 2×2 square posts. A center cross member 510 is welded between the two side frames 509. The hydraulic cylinder hangs from this frame at 511. Two feet of slide rail 512 are bolted 514 to the outside of each post in the plane of travel for the up and down movement of the tensioning assembly. In the tensioning process, the down end of the strap anchor assembly is raised up to clear the end of the joist and then lowered into position for fastening. The function of the hydraulic cylinder is to hold the strap and anchor plate in proper position for anchoring to the joist. A cross bar 515 is bolted 516 to the trolley car on the slide rail 512 on both ends of the frame. A long member 518 is welded to the end member 519 forming a rigid frame assembly. A cross member 520 is welded between the two side members 518. The ram end of the hydraulic cylinder (not shown) is attached to the cross member. The cleaves end of the adjusting bolt holding the tensioning scale 501 is anchored in the plane of pull to the same member where the pulling cylinder is anchored at 504. The opposite end of the tension scale adjusting bolt cleaves is anchored at 521 to a hanging strap 522 suspended from the traveling frame 518. Four hanging straps 522 are slotted at the top 522A to permit the strap clamp assembly 502 to be suspended during final tensioning to eliminate any friction drag on the tension that could give a false reading of the actual tension being pulled. The strap clamp 502 is welded up with two sides and a bottom wide enough to permit the strap to pass through freely. The top clamping dog 524 is a flat piece of steel with a vertical member welded in the center to pin the hanging bars to 525. The bottom of the four hanging bars 525 is radiused so that the bottom of the bar rocks along to the flat part of the clamping dog 524. This takes some of the pressure off the bottom hinge pins. The hanging bars are so designed that they create an eccentric locking action against the strap and the bottom of the strap clamp as the tension is pulled on the strap. A handle is welded to the top of one of the hanging bars to create leverage for releasing the clamp after the tensioning process is completed. A hydraulic actuated mechanism could be installed to eliminate the hand release. The hook 505 is designed to allow the inside edge of the anchor plate of the joist to rest against the back side at 526 so that a predetermined tension can be pulled on the anchor plate without putting tension on the end of the strap 503. This is done to reinforce the integrity of the crimps and clinches that will ultimately hold the strap under tension to the joist. The tested tension can be marked (etched) into the side of the joist through the computer in line with the scale and a marking device. Once the testing is done, the tension is released and the hook is hinged up at 528 to get it out of the way for tensioning the strap. The clamping dog is placed against the strap and a predetermined testing tension is pulled on the strap which is higher than the tension needed for the joist. The tension is reduced slightly to the engineered amount and the anchor plates are permanently attached to the joist.

Strap Compressor Station

Figure 26:
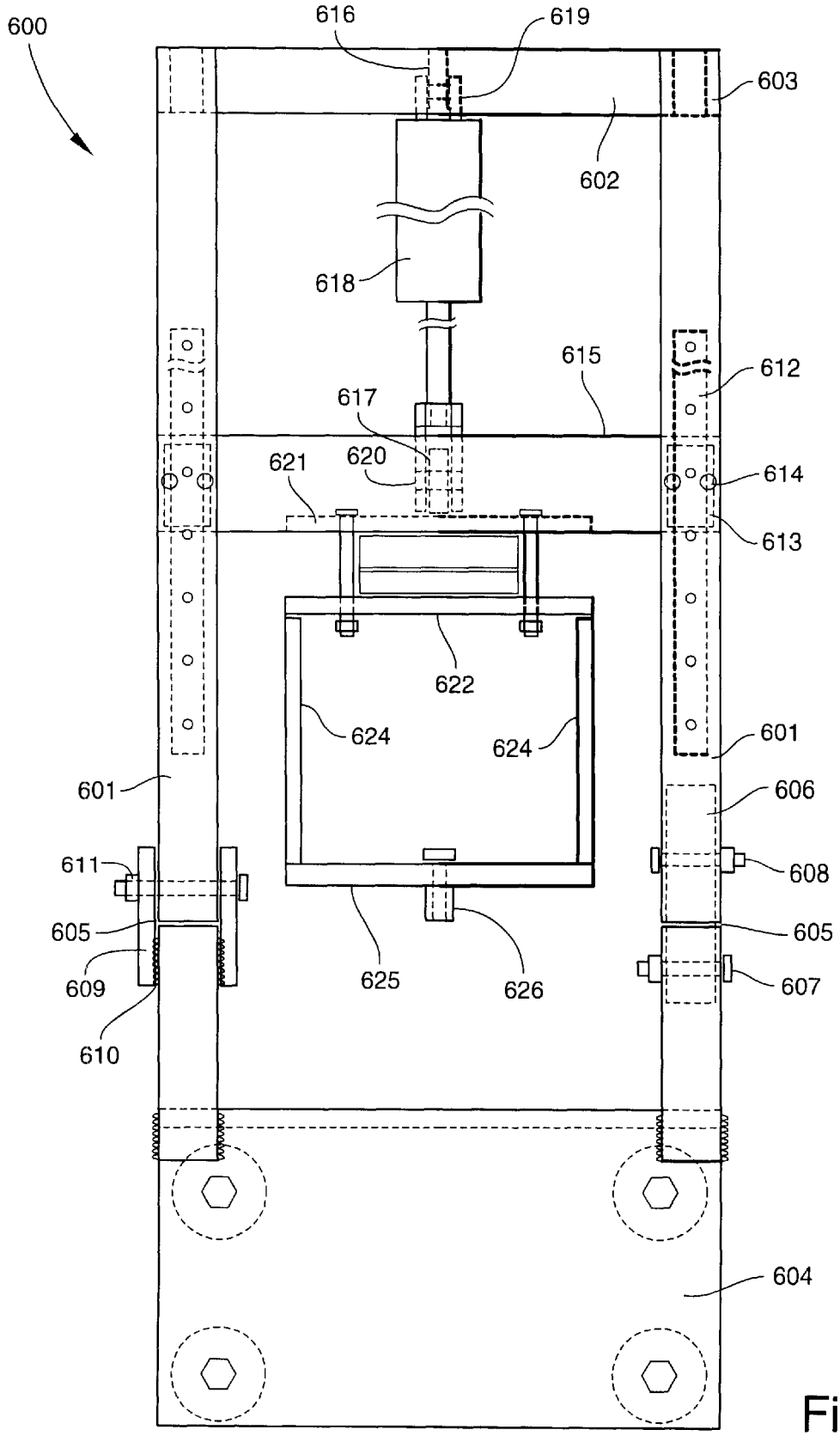
FIG. 26 is a fragmentary elevational view of a strap compressor station adapted for use in constructing a structural member according to the present invention.

Referring to FIG. 26, the strap compressor station 600 is used to measure the amount of down pressure or live load the strap or the joist can withstand. It includes a framework 601, 602, and 603 and it is welded to a trolley 604 with V-rollers to fit the inverted angles welded inside the I-beam, like the tensioning station and the clamp station. The vertical legs are cut at 605 with a solid steel dowel 606 the size of the ID of the square tubing leg bolted at 607 to the bottom half and the top half. The top bolt 608 can be removed for pivoting purposes. The other three legs have a piece of square steel tube 609 welded to the bottom half 610 and bolted at 611 when in use. The bolts are removed to permit the top part to swing out of the way for loading a joist in the system. Four slide rails 612 with cars 613 are bolted at 614 to the vertical posts 601. A cross frame 615 is bolted to car 613 at 614. A cross bar is welded to the top framework 616 and a second one to 615 at 617 to permit a hydraulic cylinder 618 to be attached at 619 and 620 allowing the mid-section to move up and down the slide rails 612. A plate 621 is welded to the frame 615, and defines four holes. A second plate 622 is drilled to match the holes in plate 621, and bolts are inserted long enough to permit an electronic compression scale to be inserted between the two plates. Legs 624 are welded under the ends of plate 622 with a narrow crossbar 625 welded under the ends of the legs. A square standoff pin 626 slightly smaller than the diameter of the tension strap is attached to the bottom of the crossbar. The extended frame is long enough to reach to the bottom of the joist where the strap would be seated. The scale reading would indicate the amount of weight the center of the joist could hold up. This station can also be used to measure the deflection and stress on top of the joist. A different plate would need to be made to bolt on at 622 to fit the top of the joist.

Thermo Stud Joist or Purlin

Figure 28:
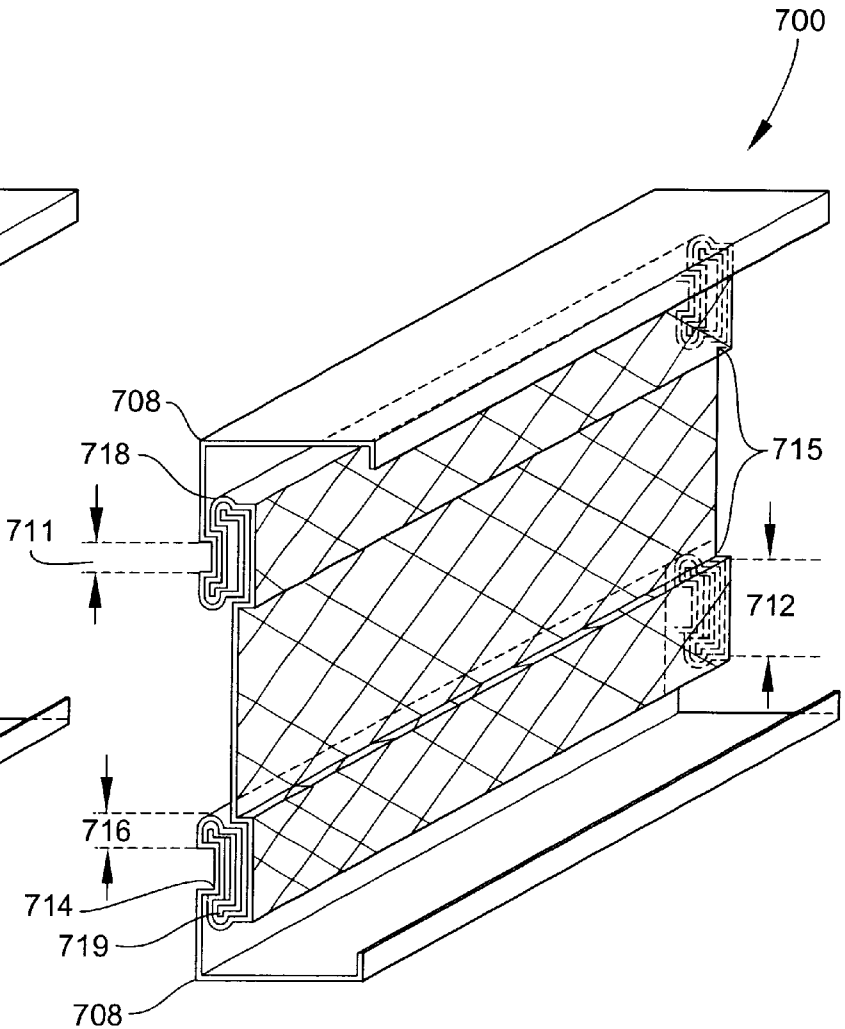
FIGS. 27 and 28 are perspective views of alternative structural members constructed using the tension strap principle of the present invention.
Figure 27:
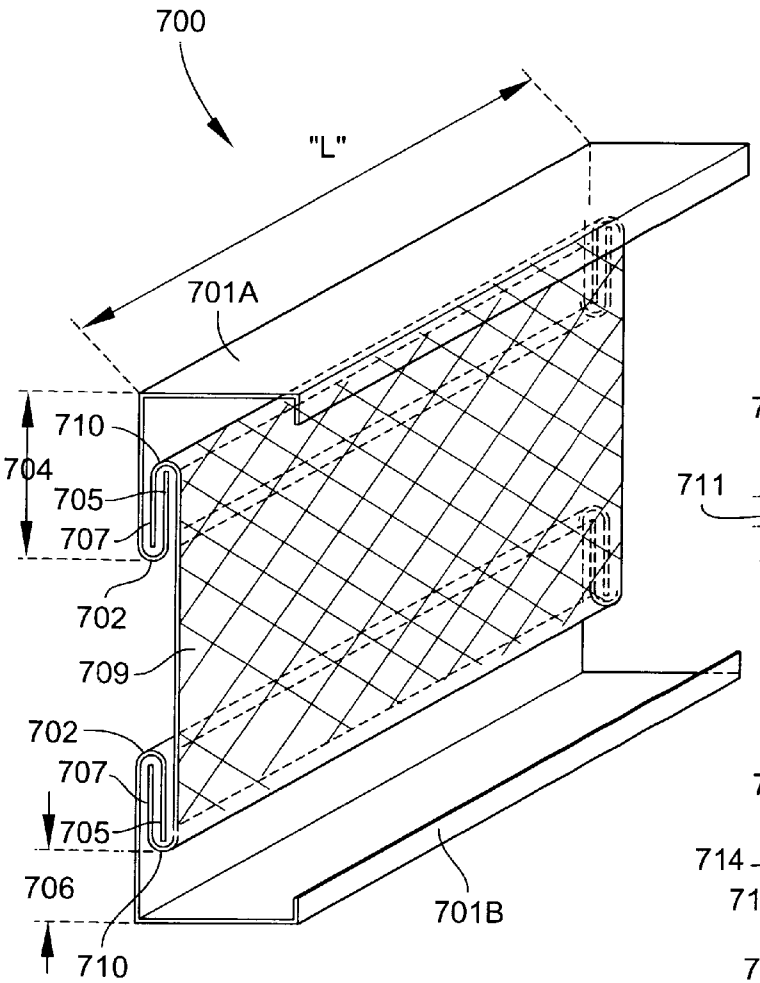

A significant disadvantage of metal framing is the amount of cold that is conducted across the member from the outside to the inside. As new ways are developed for making joists and purlins thinner and incorporating them into panels, the situation becomes more pronounced. The present thermo joist principal will greatly reduce this problem. As shown in FIGS. 27 and 28, the thermo joist 700 is formed of standard joist material 701A, 701B cut down the center or slit separately and folded at 702 to a loose fold. The amount of metal 704 not folded is greater than the folded lip 705 to permit assembly. This distance 706 is greater than the folded lip 707. In the case of a four-inch web, the break at 708 is formed after the thermo section is pressed in place. A piece of expanded metal 709 of the same or heavier gauge than the web is cut and folded at 710 creating the lip 707 the same size as the lip 705. The combined material is then placed in a roller the width of 711 as a press roller and a roller the width of 712 as the anvil roller. The difference in the dimension of roller 711 and 712 is slightly greater than twice the combined thickness of the four metals being formed. The overall length of the assembly is shown at "L". The metal thickness or surface should not be altered. If an acute angle can be created at 714 and 715 points with slanted rollers, this would increase the strength of the joint. The salvage distance 716 needs to be great enough so that the ends of the folds 705 and 707 have a small amount of unbroken material left at 718 and 719. The depth of the press is at least the combined thickness of the four metals. The compression strength of a member for a stud wall or a tension joist would be improved. The member dimensions can be engineered to anything desired.

Continuous Metal Roof Shake

Referring to FIGS. 29, 29A, 29B, 30, 30A, 30B, and 31, using the strength reinforcing tension strap, as described above, wide long-span insulated roof sections 800 can be constructed. Conventional standing seam metal roofs are minimally effective. The roof joists or purlins run parallel with the eve for forty feet, but cannot be much wider than ten feet for transportation purposes. This means the standing seam roof panel has to be cut in ten-foot lengths with a lap joint every ten feet up the slope of the roof. This defeats part of the benefit derived from standing seam metal roof panels. To combat this, a continuous metal roof shake utilizing the principle of the present invention produces long runs up the roof without a lap seam. The resulting structure has the look of a wood or asphalt shingle with the durability and water protection of a metal roof.

To form the shake 800, roll stock galvanized or painted or primed sheet metal 801 approximately 42 inches wide is fed through a double roller press engineered to create a valley into the roof panel about every foot, as indicated at 802. The panel is then fed through an edge hemming machine to create the inside edge connecting hook 803, and then fed through an edge hemming machine to create the outside connecting edge hook 804. The panel is then fed through a roller former that forms the steps in the metal to create a shingle configuration 805. The formed panel is next fed between two embossed drum roller presses three feet in circumference with a shingle pattern design milled into the surface to finish creating the embossed shingle shape 806. The panel is then stone coated to give the look of a stone-coated asphalt shingle.

Figures 29, 29A, 29B:
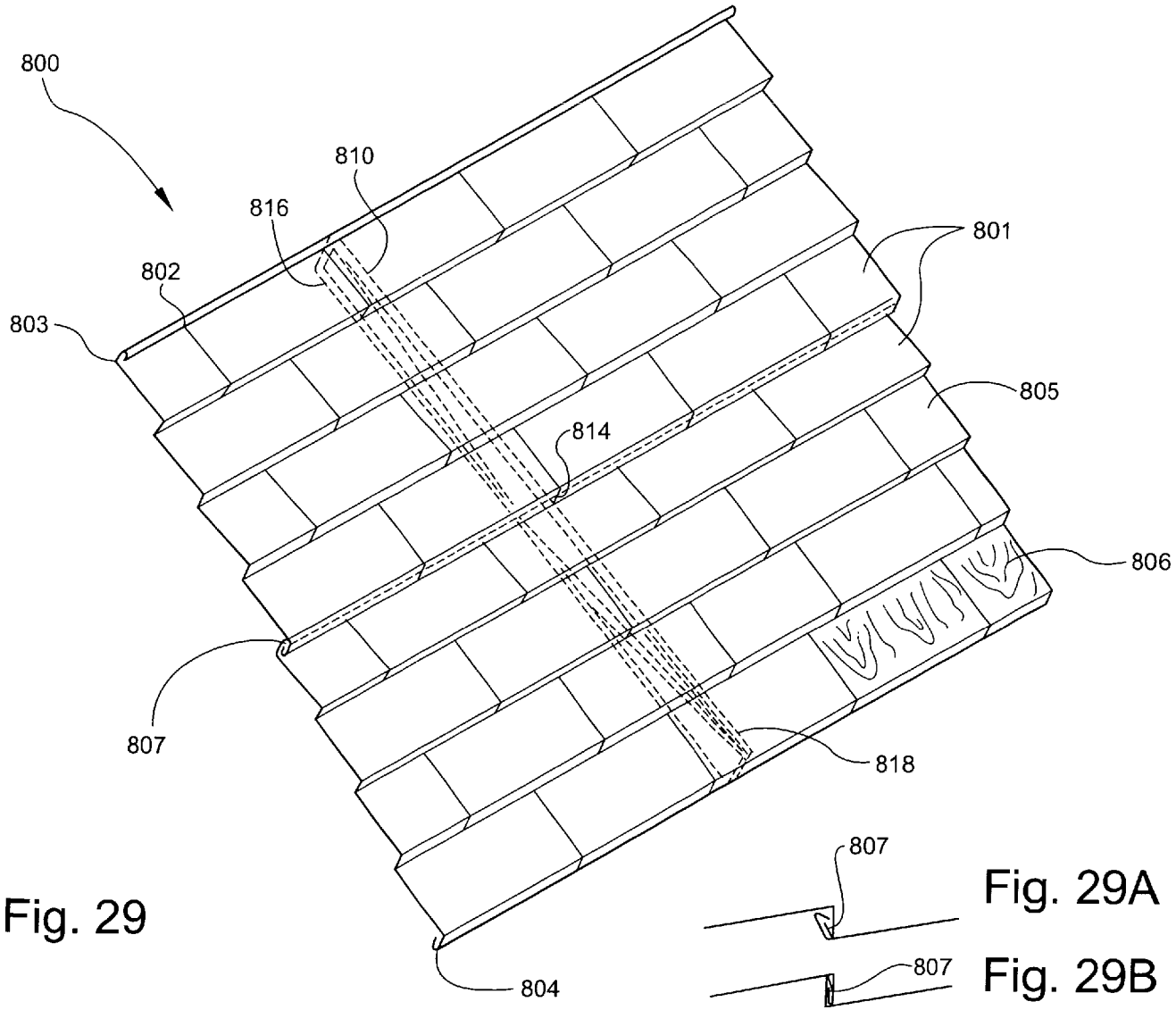
FIG. 29 is a perspective view of a portion of a continuous metal roof incorporating the tension strap principle of the present invention.
FIG. 29A is an end view showing the mating alignment of adjacent roof sections.
FIG. 29B is an end view showing the sealed joint formed at the junction of adjacent roof sections.
Figure 30:
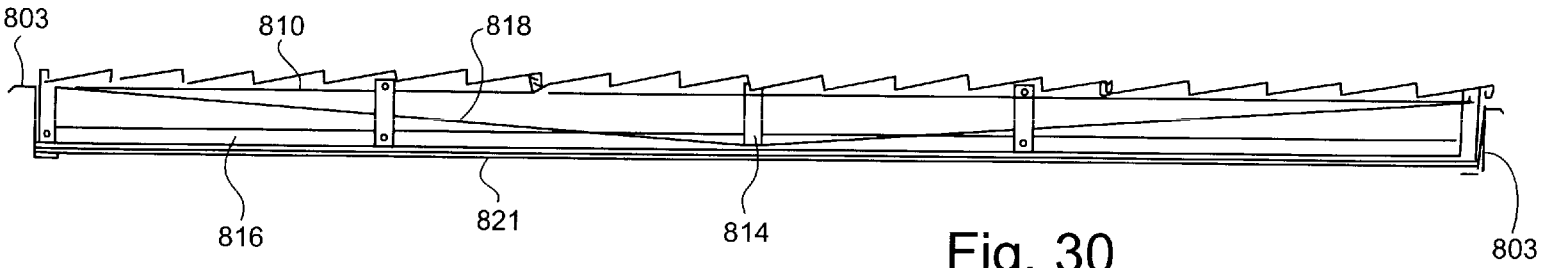
FIGS. 30 and 30A are side elevations of sections of the continuous metal roof.
Figure 30A:
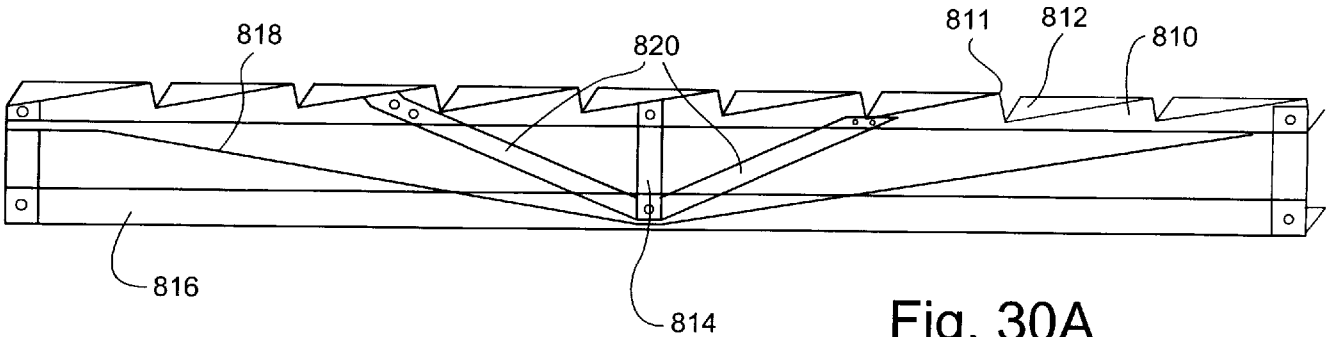
Figure 30B:
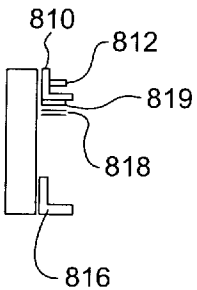
FIG. 30B is an end view of a section of the continuous metal roof.
Figure 31:
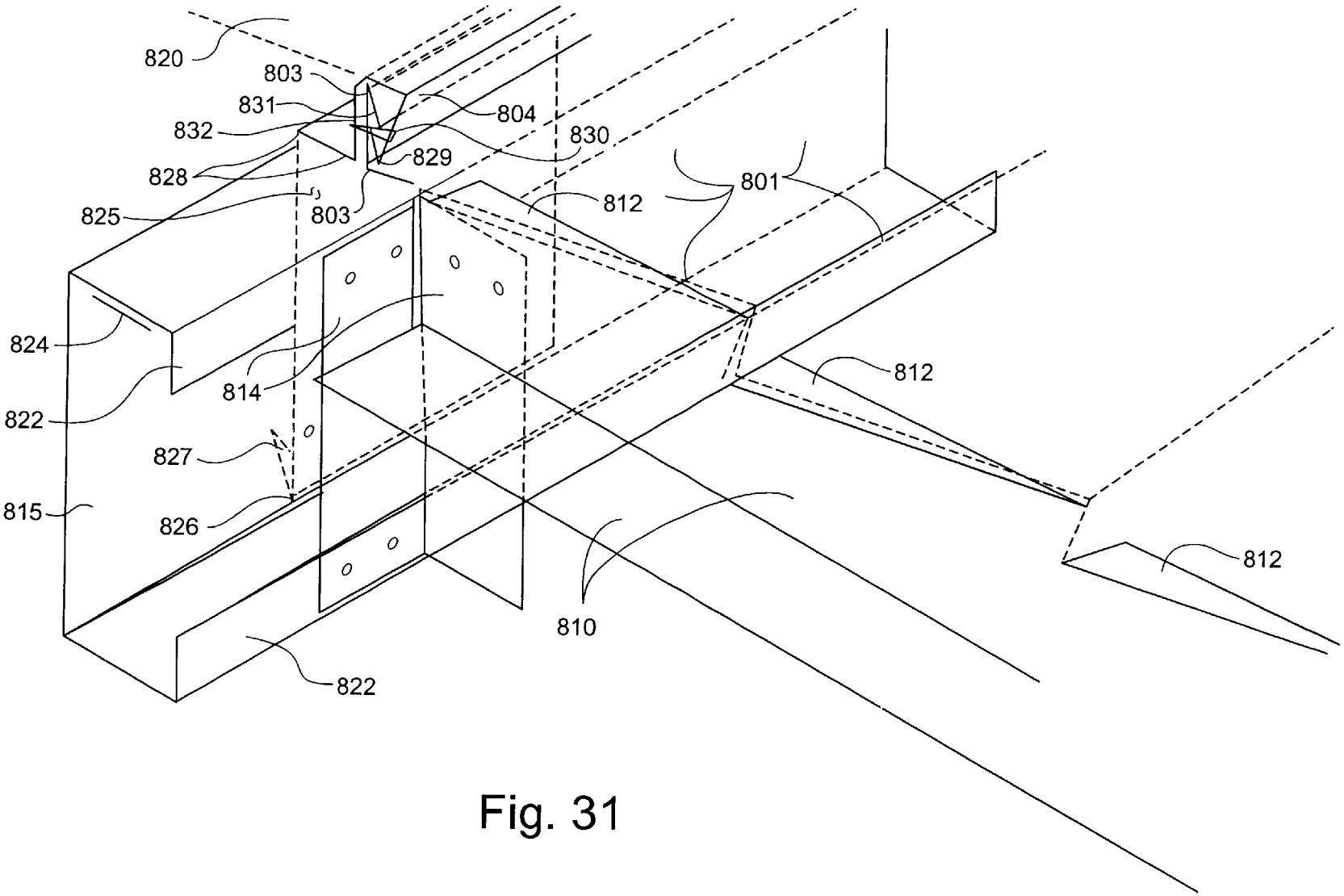
FIG. 31 is a fragmentary perspective view of the continuous metal roof.

In one application, multiple panels are joined together at 807 as shown in FIG. 29A to form a ten foot panel. To make a completely water tight seal, the panels are fed through another set of rollers to compress the two central seams tight, as shown in FIG. 29B. Preferably, glue or a sealing agent is added at the seam. The result is a roof section ten feet wide and forty feet long or whatever length is engineered. The panel is then turned upside down in a roll over jig and the cross cripple or support added, as shown in FIGS. 30 and 31. The top cord 810 is notched at 811 with 812 being flattened to fit the contour of the roof panel 801. The vertical leg of the angle formed at 810, 812 is longer to accommodate the notches 811 while maintaining sufficient strength to hold up the center of the panel. The vertical legs 814 are cut to length to be the same as the thickness of the joist 815. They are fastened at 810, 814 and to the bottom cord 816. The tension strap 818 is fastened at one end, then placed under the center tensioning post 814 and extended to the opposite end of the top cord 819. Tension is pulled on the strap, and the strap fastened to the top cord. Angle bracing 820 can be added if necessary. On a four-inch thick roof panel, more bridging or even a bar joist type of member may be necessary. Cross cripples are provided on each end and every six to ten feet down the panel. An inside ceiling 821 is added to the topside or the bottom of the cripple. The inside ceiling can be wood, gypsum, steel, fiberglass, or the like. The panel is turned right side up in the jig being held tight against the top and the bottom. The C-joist 815 is illustrated with two wide turn in flanges 822 to anchor the cripple ends at 814. The tension strap assembly is inserted in the C-joist with only the end of the strap shown at 824. A short piece of flat sheet metal 825 is double hemmed at 826 and 827 and bent with two 90 degree breaks at 828 to receive the angle of the next up roof panel to be laid. The down roof edge of the roof panel 820 is bent 90 degrees at 804 and hemmed at 829 to hook over the up roof edge of the down roof panel already in place. A recessed shoulder metal screw is inserted at 830, going through 804 below mid point, through the hem at 829, through the vertical 831 and through the sheet metal hanger at 832. As the screws are inserted every 12 inches and tightened, the hems collapse and create a water-resistant joint. Mastic can be inserted in the joint to further waterproof the joint. The center is filled from the down roof edge of the panel with a foam type insulation, such as expanded urethane-isocinate insulation. The foam is shaved flush with the edge of the panel and the purlins fastened to the ends of the cripples. The tension strap is added to the purlins and pulled to tension as previously described. The panel is then ready for shipping.

A plurality of structural members incorporating the tension strap principle of the present invention are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A load-bearing structural member, comprising:

(a) a structure body having a first and second opposing sides, and first and second opposing ends;

(b) a strength-reinforcing flat steel strap extending along the length of said structure body from one end to the other, and adapted for transferring an intermediate load acting on said structure body outwardly to the opposing ends of said structure body; and (c) first and second anchors located at opposite ends of said structure body for engaging and anchoring said strap at respective opposite ends of said structure body and holding said strap in tension at the first side of said structure body, each of said anchors comprising first and second complementary anchor plates having a series of mating, spaced-apart, lateral crimps; and (d) means located between the ends of said structure body for engaging and holding said strap adjacent the second side of said structure body, thereby creating an increased supporting reaction force between the ends of said structure body at the location of said means.

2. A structural member according to claim 1, wherein said means comprises a vertical tensioning post centrally located between the ends of said structure body.

3. A structural member according to claim 1, wherein said strap is formed of light-gauge, stress-proof steel having a tensile strength of at least 100,000 psi.

4. A structural member according to claim 1, wherein said structure body is formed of light-gauge steel.

5. A structural member according to claim 1, wherein said structure body has a generally V-shaped or U-shaped cross-section, and comprises a bottom, opposing sides integrally formed with said bottom, and respective flanges integrally formed with said sides.

6. A structural member according to claim 5, wherein each of said flanges includes a longitudinal fastener groove for receiving fasteners.

7. A structural member according to claim 5, and comprising at least one lateral spreader bar located between the sides of said structure body to maintain uniform spacing of the sides from one end of the structure body to the other.

8. A structural member according to claim 1, wherein the depth of the crimps of each anchor plate increases from an inside edge to an outside edge of the anchor plate.

9. A structural member according to claim 8, wherein the width of the crimps is no greater than 80% of the width of the strap.

10. A structural member according to claim 1, wherein said anchor plates are attached to said structure body by a plurality of fasteners extending through the structure body and anchor plates, and adjacent to opposing side edges of strap.

11. A structural member according to claim 1, wherein said anchor plates extend at an angle from the first side of said structure body towards the second side of said structure body to define a sloping bed for holding said strap.

12. A structural member according to claim 1, wherein said structure body comprises a steel C-channel including a vertical web member and spaced-apart top and bottom flange members integrally formed with said web member.

13. A structural member according to claim 12, and comprising top and bottom support panels attached to respective top and bottom flange members of said C-channel.

14. A structural member according to claim 13, wherein said flange members include respective integrally-formed hooks adapted for mating with complementary hooks formed with respective top and bottom support panels for connecting said support panels and said structure body together.

* * * * *